US010063952B2

(12) United States Patent
Fuchs et al.

(10) Patent No.: US 10,063,952 B2
(45) Date of Patent: Aug. 28, 2018

(54) ACOUSTIC PILLOW

(71) Applicant: Kushion, LLC, Eatontown, NJ (US)

(72) Inventors: David Fuchs, West Long Branch, NJ (US); Shelton McCoy, Charlotte, NC (US); Robert Heiblim, Caldwell, NJ (US)

(73) Assignee: Comfort Revolution, LLC, West Long Branch, NJ (US)

( * ) Notice: Subject to any disclaimer, the term of this patent is extended or adjusted under 35 U.S.C. 154(b) by 0 days.

(21) Appl. No.: 15/246,380

(22) Filed: Aug. 24, 2016

(65) Prior Publication Data

US 2018/0063612 A1 Mar. 1, 2018

(51) Int. Cl.

| | |
|---|---|
| ***H04R 1/02*** | (2006.01) |
| ***A47G 9/10*** | (2006.01) |
| *A47G 9/00* | (2006.01) |

(52) U.S. Cl.

CPC ..... *H04R 1/028* (2013.01); *A47G 9/1045* (2013.01); *A47G 2009/005* (2013.01); *A47G 2009/006* (2013.01); *A47G 2009/1018* (2013.01); *H04R 1/023* (2013.01); *H04R 2420/07* (2013.01)

(58) Field of Classification Search

CPC .... H04R 1/028; H04R 1/023; H04R 2420/07; A47G 9/1045; A47G 2009/005; A47G 2009/0063; A47G 2009/1018

See application file for complete search history.

(56) References Cited

U.S. PATENT DOCUMENTS

| | | | | |
|---|---|---|---|---|
| 3,290,450 | A * | 12/1966 | Majoros | H04R 5/023 381/182 |
| D699,217 | S | 2/2014 | McCoy | |
| 2007/0124862 | A1 | 6/2007 | Beyda | |
| 2007/0277319 | A1* | 12/2007 | Calvert | A47G 9/1009 5/638 |
| 2009/0089931 | A1 | 4/2009 | Vandenbelt | |
| 2013/0014328 | A1* | 1/2013 | Requet | A47G 9/109 5/640 |
| 2015/0342377 | A1* | 12/2015 | Hall | A47G 9/1045 345/156 |
| 2016/0029822 | A1* | 2/2016 | Cappadona | A47C 27/002 5/636 |

* cited by examiner

*Primary Examiner* — Andrew L Sniezek
(74) *Attorney, Agent, or Firm* — Doherty IP Law Group LLC

(57) ABSTRACT

An acoustic pillow includes a pillow body top having an outer surface and an inner surface with assembly projections extending from the inner surface, and a pillow body base having an outer surface and an inner surface with assembly depressions molded into the inner surface of the pillow body base. The pillow body top is assembled with the pillow body base with the inner surface of the pillow body top opposing the inner surface of the pillow body base and the assembly projections inserted into the assembly depressions. The acoustic pillow includes a wireless communication system disposed between the pillow body base and the pillow body top having a controller housing, a power source, at least one speaker housing, and a controller interface housing for operating the acoustic pillow.

19 Claims, 23 Drawing Sheets

FIG. 2A
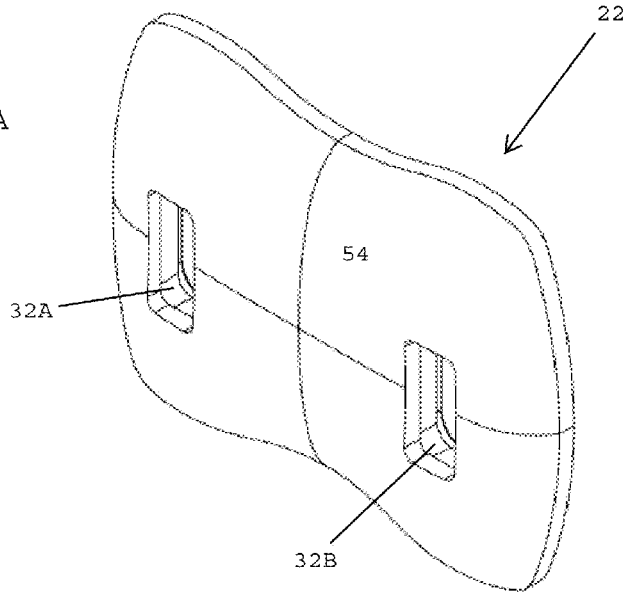
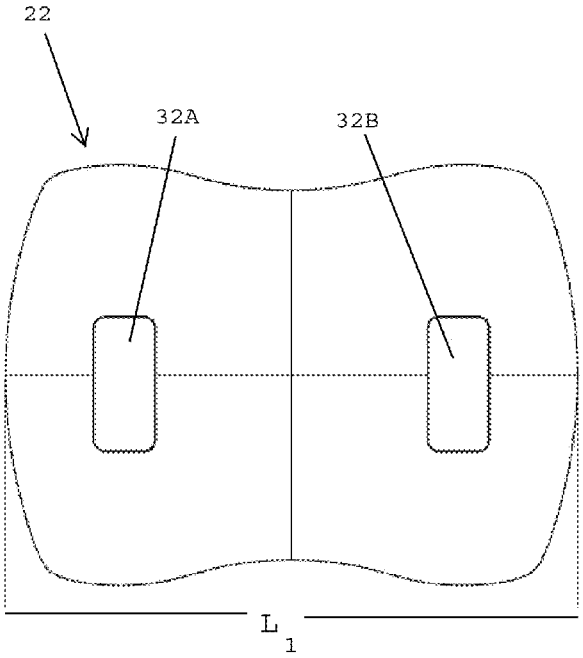
FIG. 2B
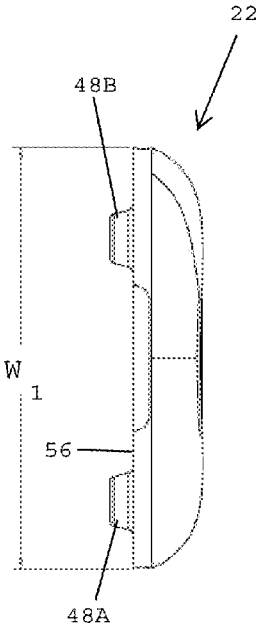
FIG. 2C

FIG. 3A
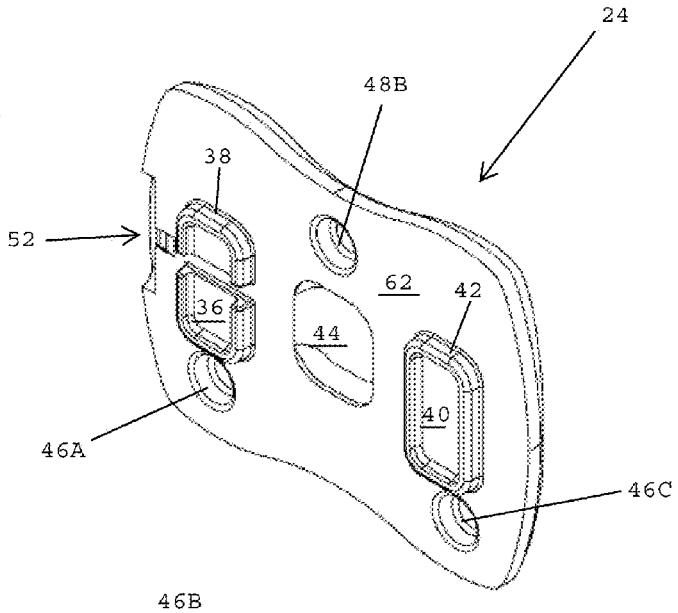
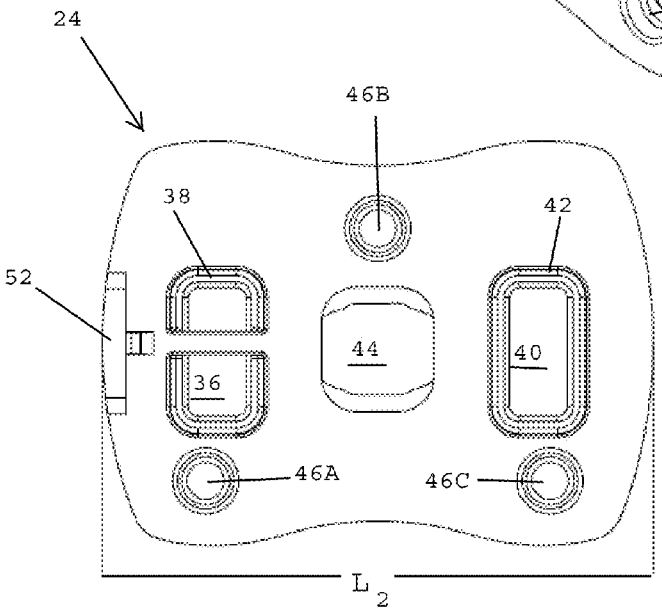
FIG. 3B
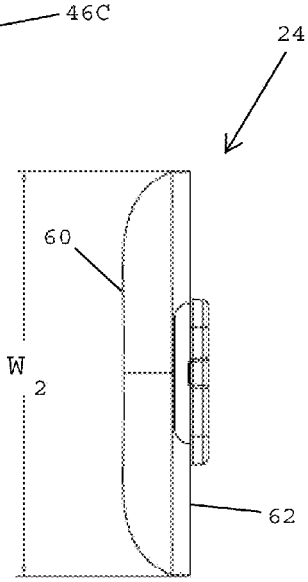
FIG. 3C
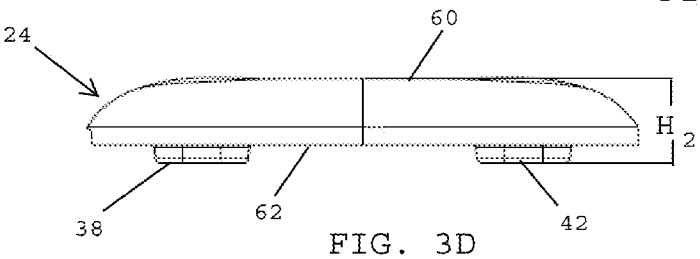
FIG. 3D

FIG. 4A
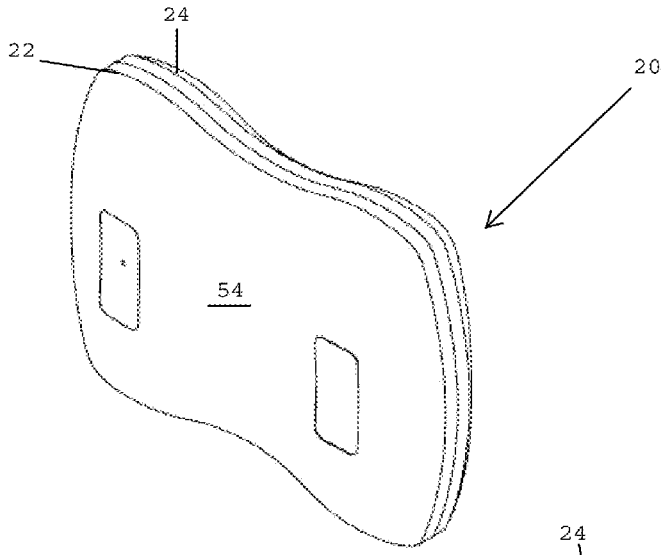
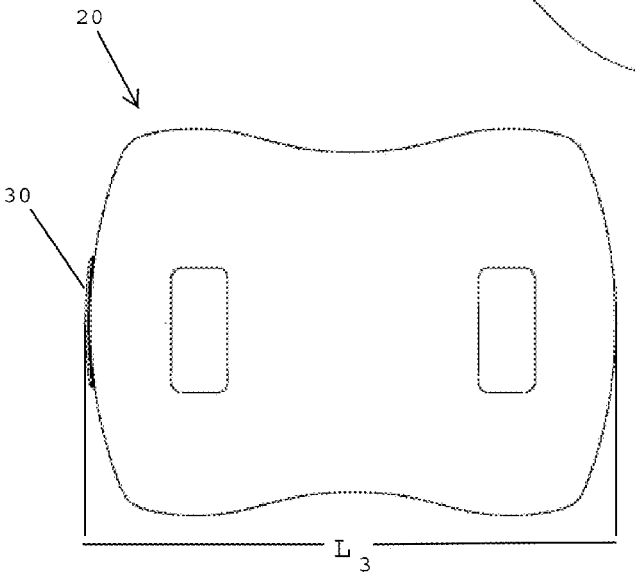
FIG. 4B
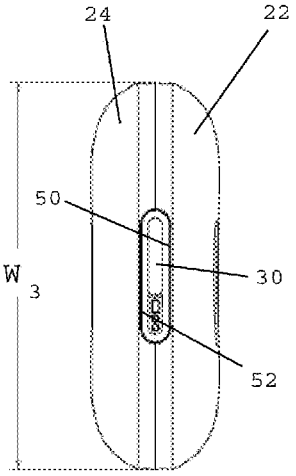
FIG. 4C
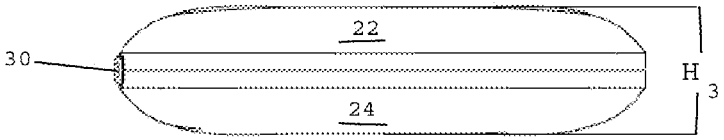
FIG. 4D

FIG. 5A
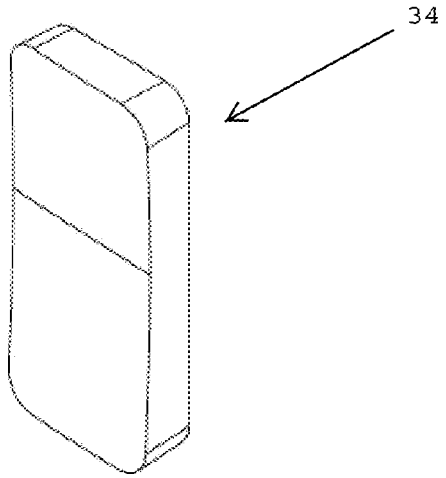
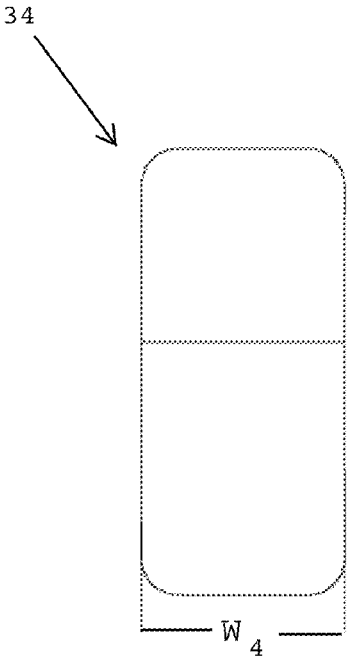
FIG. 5B
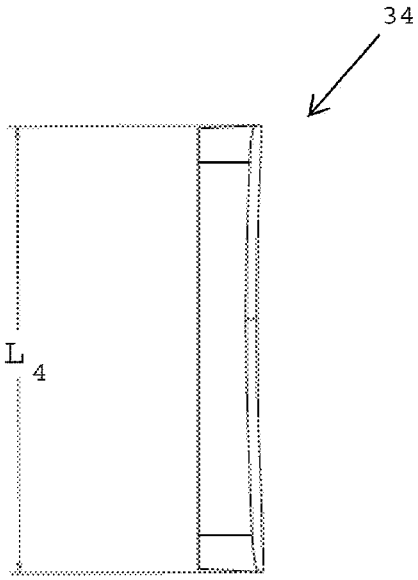
FIG. 5C
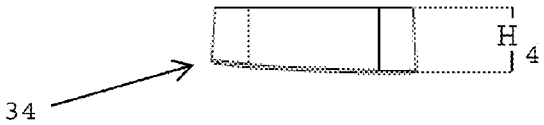
FIG. 5D

FIG. 8A
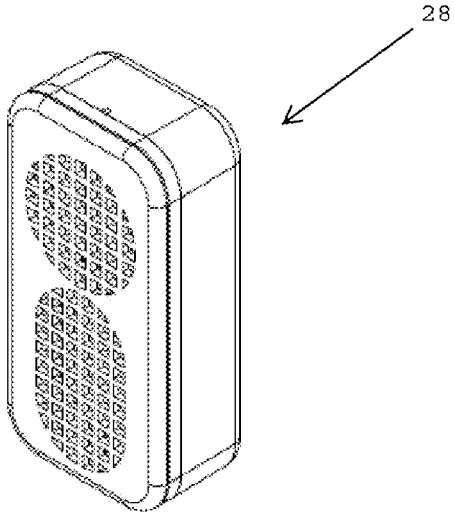
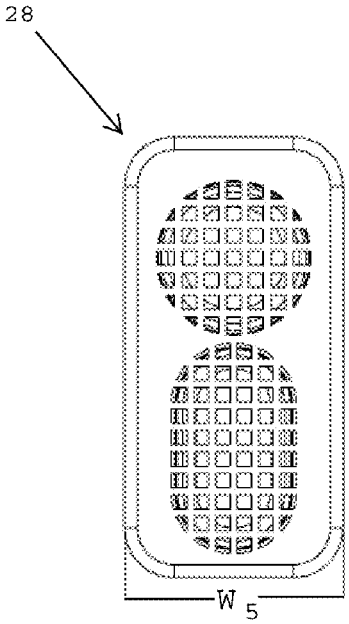
FIG. 8B
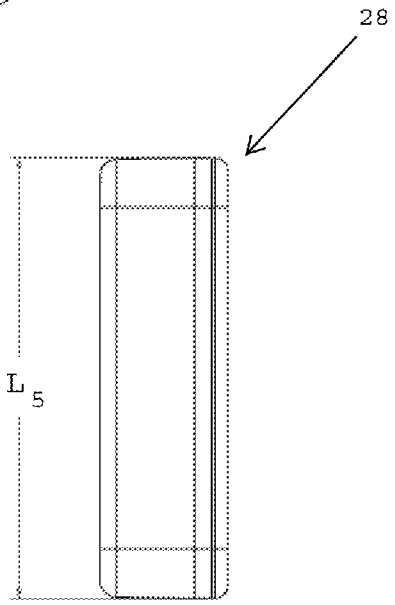
FIG. 8C
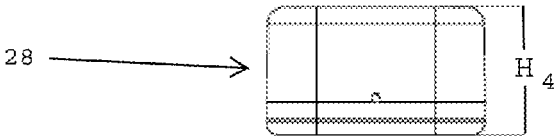
FIG. 8D

FIG. 9A
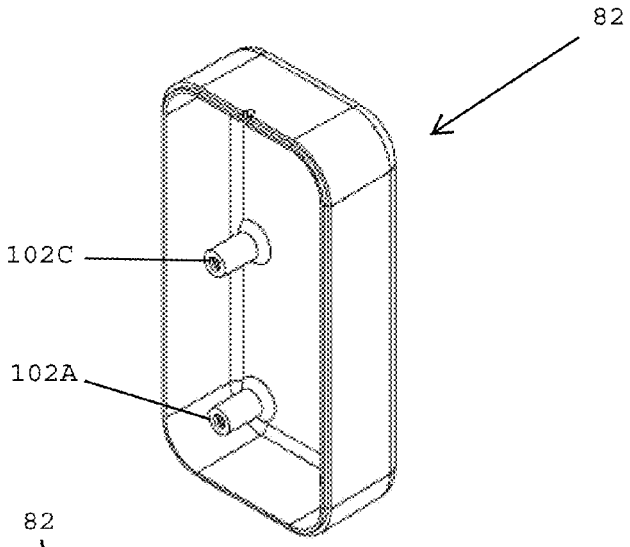
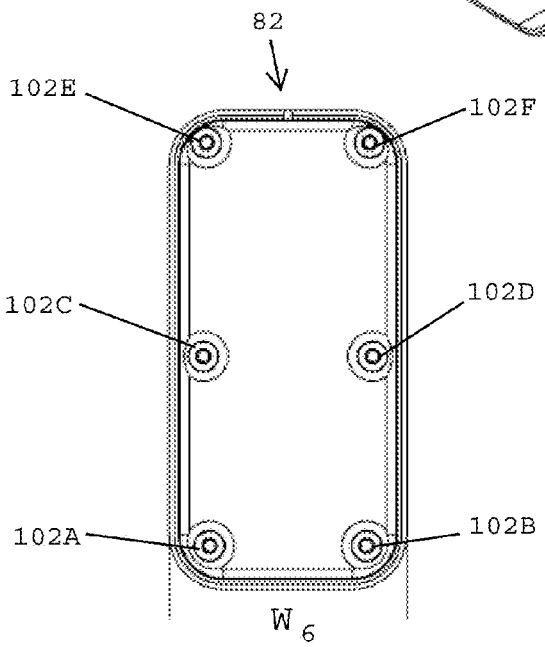
FIG. 9B
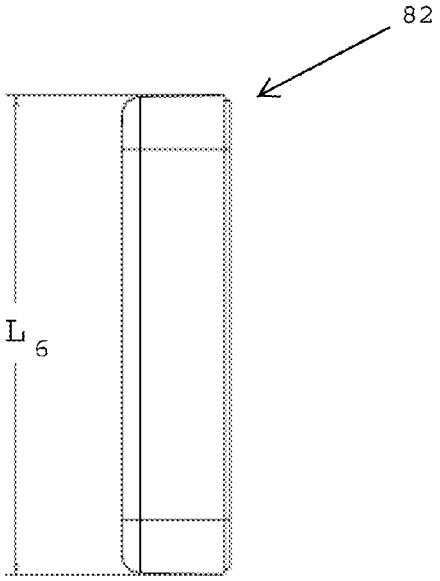
FIG. 9C
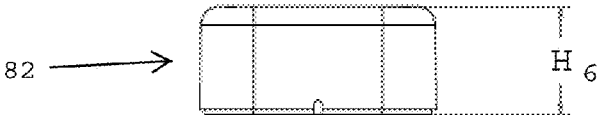
FIG. 9D

FIG. 10A
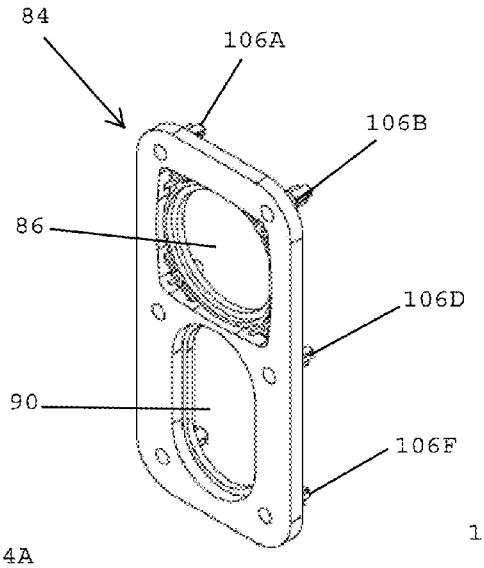
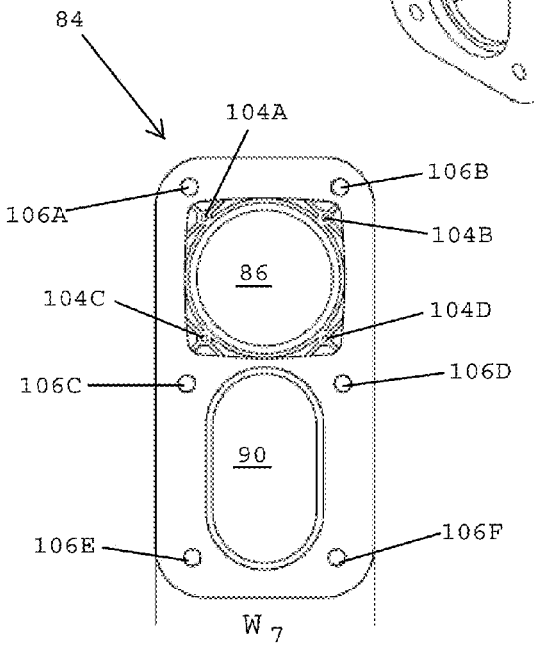
FIG. 10B
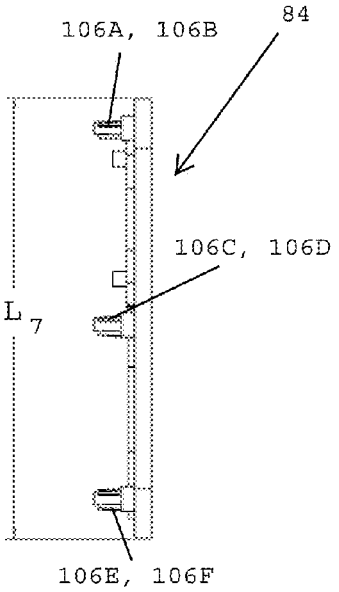
FIG. 10C
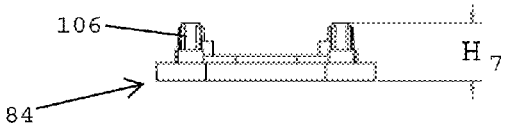
FIG. 10D

FIG. 11A
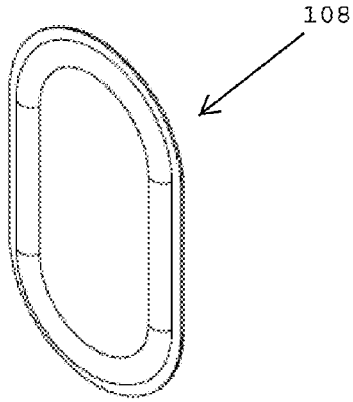
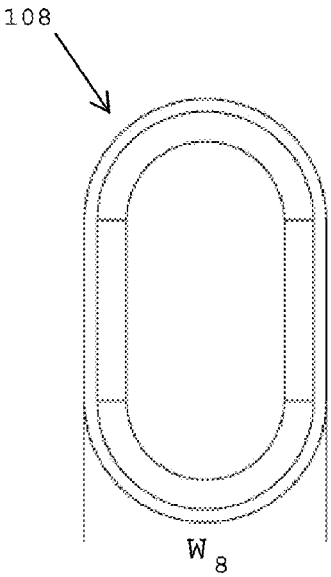
FIG. 11B
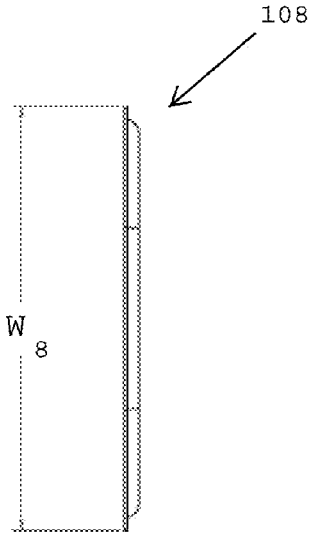
FIG. 11C
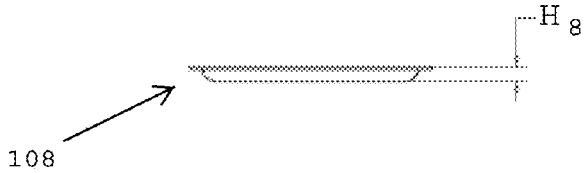
FIG. 11D

FIG. 12A
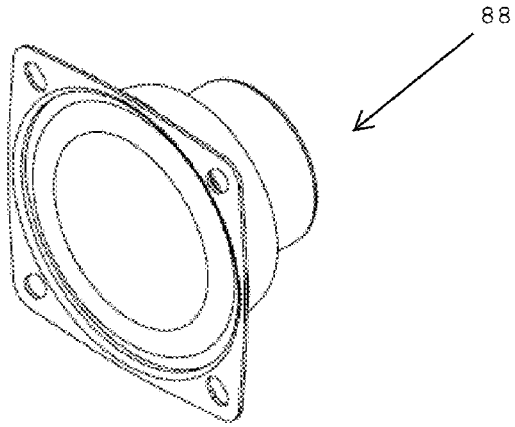
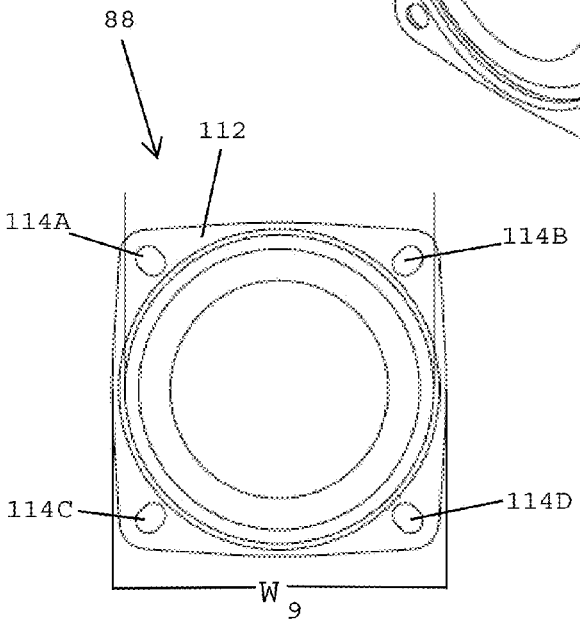
FIG. 12B
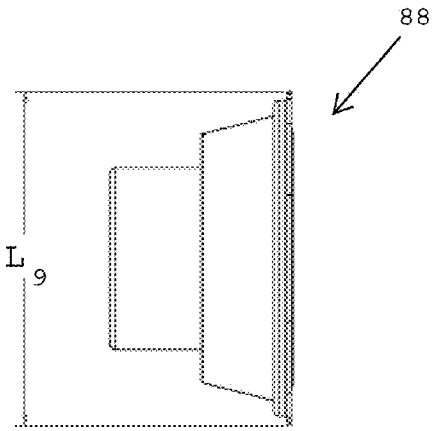
FIG. 12C
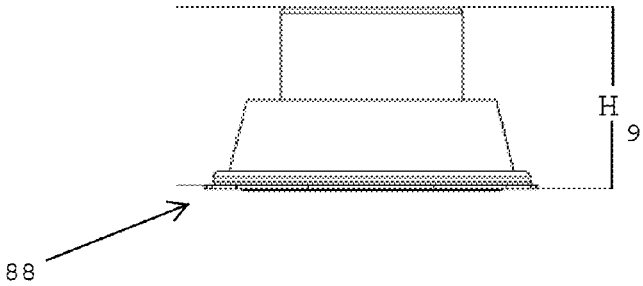
FIG. 12D

FIG. 13A
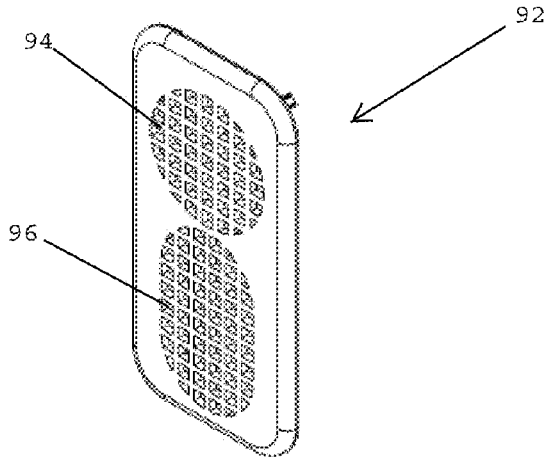
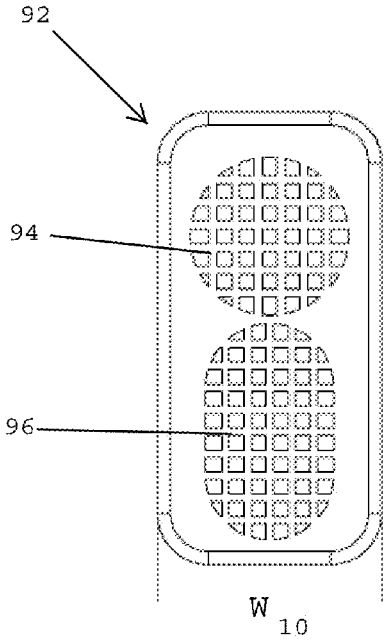
FIG. 13B
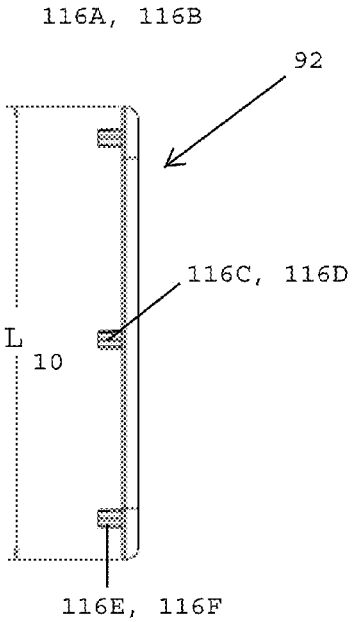
FIG. 13C
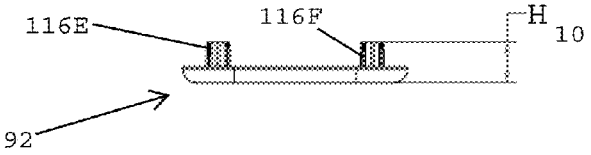
FIG. 13D

FIG. 15A
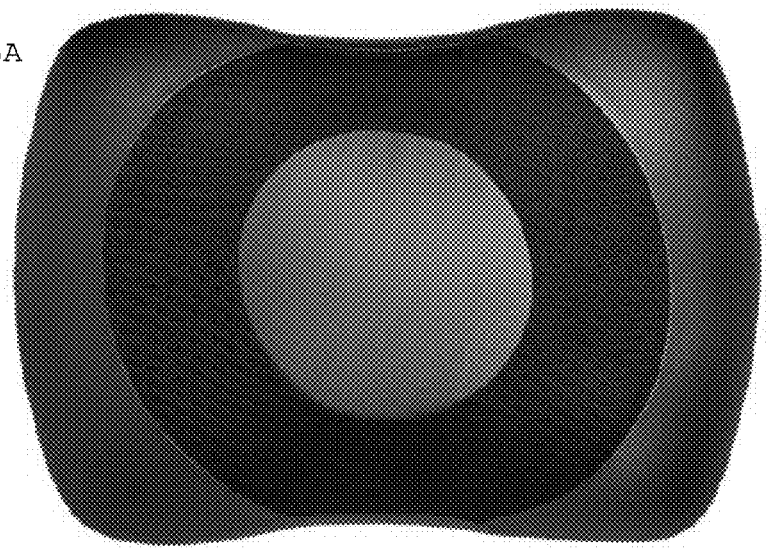
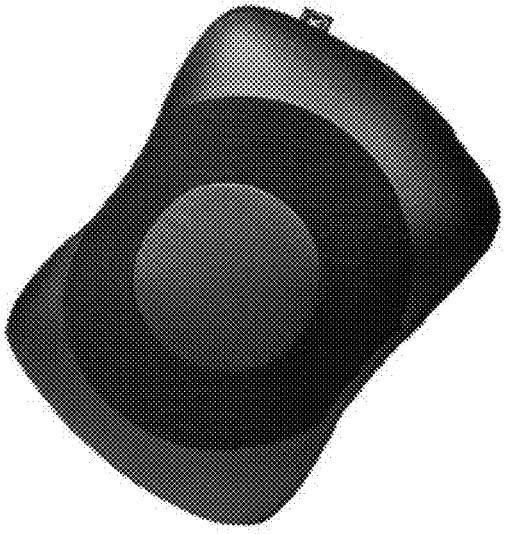
FIG. 15B
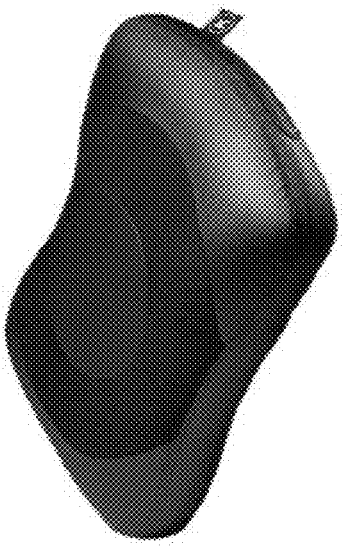
FIG. 15C

ACOUSTIC PILLOW

BACKGROUND OF THE INVENTION

Field of the Invention

The present patent application is generally related to pillows, and is more specifically related to pillows having speakers and wireless communication technology incorporated therein.

Description of the Related Art

Pillows and cushions having speakers incorporated therein are well known in the prior art. For example, U.S. Pat. Nos. 7,627,917, 6,044,161, 5,201,002, and 5,123,133 all disclose pillows having speakers.

Unfortunately, the acoustical quality of conventional speaker pillows is poor. In addition, conventional speaker pillows are unreliable between the electrical components and wiring may become stretched or break during use. Moreover, the speakers used in conventional speaker pillows are of poor quality.

Thus, there exists a need for pillows having speakers that produce better acoustics, that are more reliable, and that maximize listener enjoyment.

There also exists a need for speaker pillows that are easier to operate and that have an improved ornamental design.

In view of the above deficiencies, there is a continuing need for improved speaker pillows having enhanced acoustics.

SUMMARY OF THE INVENTION

In one embodiment, an acoustic pillow includes a pillow body top having an outer surface and an inner surface with assembly projections extending from the inner surface, and a pillow body base having an outer surface and an inner surface with assembly depressions molded into the inner surface of the pillow body base. In one embodiment, the pillow body top is assembled with the pillow body base with the inner surface of the pillow body top opposing the inner surface of the pillow body base and the assembly projections being inserted into the assembly depressions. In one embodiment, a wireless communication system is disposed between the pillow body top and the pillow body base. In one embodiment, the wireless communication system includes a controller housing, a power source, at least one speaker housing, and a controller interface housing for operating the acoustic pillow.

In one embodiment, the controller housing holds a circuit board having at least one microprocessor and at least one a wireless communication device for sending and receiving wireless signals. In one embodiment, the power source (e.g., a lithium ion battery) is disposed in the controller housing. In one embodiment, the pillow body base has a controller housing depression molded into the inner surface of the pillow body base and the controller housing is disposed in the controller housing depression.

In one embodiment, the controller interface housing is in signal sending and receiving communication with the circuit board including the at least one microprocessor and the at least one wireless communication device. In one embodiment, the controller interface housing has buttons, ports, and visual indicators for interacting with the controller housing for operating the acoustic pillow.

In one embodiment, the acoustic pillow has first and second speaker openings formed in the pillow body top that extend from the outer surface to the inner surface of the pillow body top. In one embodiment, first and second molded speaker rims project above the inner surface of the pillow body base. When the pillow body top and the pillow body base are assembled together, the first speaker rim is inserted into the first speaker opening and the second speaker rim is inserted into the second speaker opening.

In one embodiment, an acoustic pillow includes a first speaker housing having a lower end surrounded by the first speaker rim and an upper end inserted into the first speaker opening, and a second speaker housing having a lower end surrounded by the second speaker rim and an upper end inserted into the second speaker opening.

In one embodiment, an acoustic pillow includes a first acoustic insert disposed in the first speaker opening, the first acoustic insert having a top surface that lies in a plane defined by the outer surface of the pillow body top and a bottom surface spaced away from the outer surface of the pillow body top. In one embodiment, an acoustic pillow includes a second acoustic insert disposed in the second speaker opening, the second acoustic insert having a top surface that lies in a plane defined by the outer surface of the pillow body top and a bottom surface spaced away from the outer surface of the pillow body top.

In one embodiment, the acoustic inserts are made or reticulated foam and/or foam that is more porous than the pillow body top and pillow body base, which may be made of memory foam. In one embodiment, the pillow body top, the pillow body base, and the first and second acoustic inserts are made of polyurethane foam, whereby the foam used to make the first and second acoustic inserts is more porous than the foam used to make the pillow body top and the pillow body base.

In one embodiment, the first acoustic insert has a thickness of about 0.700-0.900 inches, and more preferably about 0.826 inches, and the upper end of the first speaker housing is spaced away from the bottom surface of the first acoustic insert by about 0.600-0.800 inches. In one embodiment, the second acoustic insert has a thickness of about 0.700-0.900 inches, and more preferably about 0.826 inches, and the upper end of the second speaker housing is spaced away from the bottom surface of the second acoustic insert by about 0.600-0.800 inches.

In one embodiment, the upper ends of the first and second speaker housings are about 1.50 inches below the outer surface of the pillow body top. In one embodiment, an air gap is present between the upper ends of the first and second speaker housings and the respective bottom surfaces of the first and second acoustic inserts. In one embodiment, the air gaps improve the acoustical performance of the speakers.

In one embodiment, a first controller interface housing groove is formed on one side of the pillow body top, and a second controller interface housing groove is formed on one side of the pillow body base that opposes the first controller interface housing groove. In one embodiment, the controller interface housing is disposed between the first and second controller interface housing grooves for securing the controller interface housing to one side of the acoustic pillow.

In one embodiment, the acoustic pillow includes conductive wires interconnecting the controller interface housing and the controller housing, and speaker wires interconnecting the controller housing and the one or more speaker housings.

In one embodiment, the pillow body top and the pillow body base comprise memory foam and the assembly projections, assembly depressions, speaker openings, speaker rims, and controller interface housing grooves are molded into the pillow body top and/or pillow body base.

In one embodiment, the acoustic pillow includes a flexible cover surrounding the pillow body top and the pillow body base. In one embodiment, the flexible cover may be made of cloth, fabric, leather, plastic, and/or combinations thereof.

In one embodiment, the first and second acoustic inserts are made of foam that is more porous than the memory foam pillow body top and pillow body base. In one embodiment, the first and second acoustic inserts are made of reticulated foam.

In one embodiment, an acoustic pillow includes a pillow body top made of memory foam, the pillow body top having an outer surface, an inner surface with assembly projections extending from the inner surface, and first and second speaker openings that extend from the outer surface to the inner surface of the pillow body top, and a pillow body base made of memory foam, the pillow body base having an outer surface and an inner surface with assembly depressions molded into the inner surface of the pillow body base, the pillow body base including first and second molded speaker rims projecting above the inner surface of the pillow body base.

In one embodiment, the pillow body top is assembled with the pillow body base with the inner surface of the pillow body top opposing the inner surface of the pillow body base, the assembly projections inserted into the assembly depressions, the first molded speaker rim inserted into the first speaker opening, and the second molded speaker rim inserted into the second speaker opening.

In one embodiment, a first speaker housing having a lower end is surrounded by the first molded speaker rim and an upper end of the first speaker housing is inserted into the first speaker opening, and a second speaker housing having a lower end is surrounded by the second molded speaker rim and an upper end of the second speaker housing is inserted into the second speaker opening.

In one embodiment, a first acoustic insert made of reticulated foam is disposed in the first speaker opening and overlies the first speaker housing, the first acoustic insert having a top surface that lies in a plane defined by the outer surface of the pillow body top and a bottom surface spaced away from the outer surface of the pillow body top.

In one embodiment, a second acoustic insert made of reticulated foam is disposed in the second speaker opening and overlies the second speaker housing, the second acoustic insert having a top surface that lies in a plane defined by the outer surface of the pillow body top and a bottom surface spaced away from the outer surface of the pillow body top.

In one embodiment, the first acoustic insert has a thickness of about 0.700-0.900 inches and the upper end of the first speaker housing is spaced away from the bottom surface of the first acoustic insert by about 0.600-0.800 inches, and the second acoustic insert has a thickness of about 0.700-0.900 inches and the upper end of the second speaker housing is spaced away from the bottom surface of the second acoustic insert by about 0.600-0.800 inches.

In one embodiment, the acoustic pillow includes a wireless communication system disposed between the pillow body base and the pillow body top. In one embodiment, the wireless communication system includes a controller housing, a power source, the first and second speaker housings in communication with the controller housing, and a controller interface housing in communication with the controller housing.

In one embodiment, the acoustic pillow has a single speaker. In one embodiment, the acoustic pillow may have an array of speakers (e.g., two or more speakers).

In one embodiment, the position of the speakers relative to the outer surface of the pillow may be modified to optimize sound quality. In one embodiment, the speakers may be recessed. In one embodiment, the speakers may be elevated to the outer surface of the pillow to provide a sought after optimal sound. In one embodiment, the position of the speakers relative to the outer surface of the pillow may be modifiable. In one embodiment, an acoustic pillow may not have acoustic inserts disposed in speaker openings.

The acoustic pillow disclosed herein is designed to maximize sound at a forward facing directional position with a certain degree of broadcast. Laying the pillow face down or flat somewhat reduces the ability of the product to perform with optimal sound. In one embodiment, the sound may be enhanced by positioning the product against walls. In one embodiment, in order to achieve a most efficient bass, the acoustic pillow may be placed in a corner.

In one embodiment, the acoustic pillow disclosed herein is not solely intended to be used with music or phone devices, but rather any device having Blue Tooth capabilities. In one embodiment, the acoustic pillow may be used to provide sound for TV's and other media devices, e.g., for TV viewing, video game playing, etc.

In one embodiment, the flexible outer cover for the acoustic pillow may be waterproof or include a waterproof material.

In one embodiment, the acoustic pillow has the shape of a traditional pillow. In other embodiments, however, the acoustic pillow may have different shapes or configurations that are suitable for travel and other lifestyle designs, choices or needs.

In one embodiment, the acoustic pillow utilizes Bluetooth technology, however, other embodiments may incorporate Wi-Fi, NFC, Zwave or other communication protocols or capabilities.

In one embodiment, an acoustic pillow may be customized using an app or web browser. The customization protocol may allow for remote control of electronic devices using the internet or mobile devices. In one embodiment, an acoustic pillow may be controlled and/or customized using products such as WeMo, Alexa, etc.

These and other preferred embodiments of the present invention will be described in more detail below.

BRIEF DESCRIPTION OF THE DRAWING

FIGS. 2A-2E show a pillow body top, in accordance with one embodiment of the present invention.

FIGS. 3A-3D show a pillow body base of an acoustic pillow, in accordance with one embodiment of the present invention.

FIGS. 4A-4D show the pillow body top of FIGS. 2A-2D assembled with the pillow body base of FIGS. 3A-3D.

FIGS. 5A-5D show an acoustic insert for a pillow body of an acoustic pillow, in accordance with one embodiment of the present invention.

FIGS. 8A-8D show a speaker housing assembly for an acoustic pillow, in accordance with one embodiment of the present invention.

FIGS. 9A-9D show a speaker housing base, in accordance with one embodiment of the present invention.

FIGS. 10A-10D show a speaker housing top, in accordance with one embodiment of the present invention.

FIGS. 11A-11D show a passive radiator for a speaker housing assembly, in accordance with one embodiment of the present invention.

FIGS. 12A-12D show a speaker driver, in accordance with one embodiment of the present invention.

FIGS. 13A-13D show a speaker housing grill, in accordance with one embodiment of the present invention.

FIGS. 15A-15F shows an acoustic pillow, in accordance with one embodiment of the present invention.

DETAILED DESCRIPTION OF PREFERRED EMBODIMENTS

Figure 1:
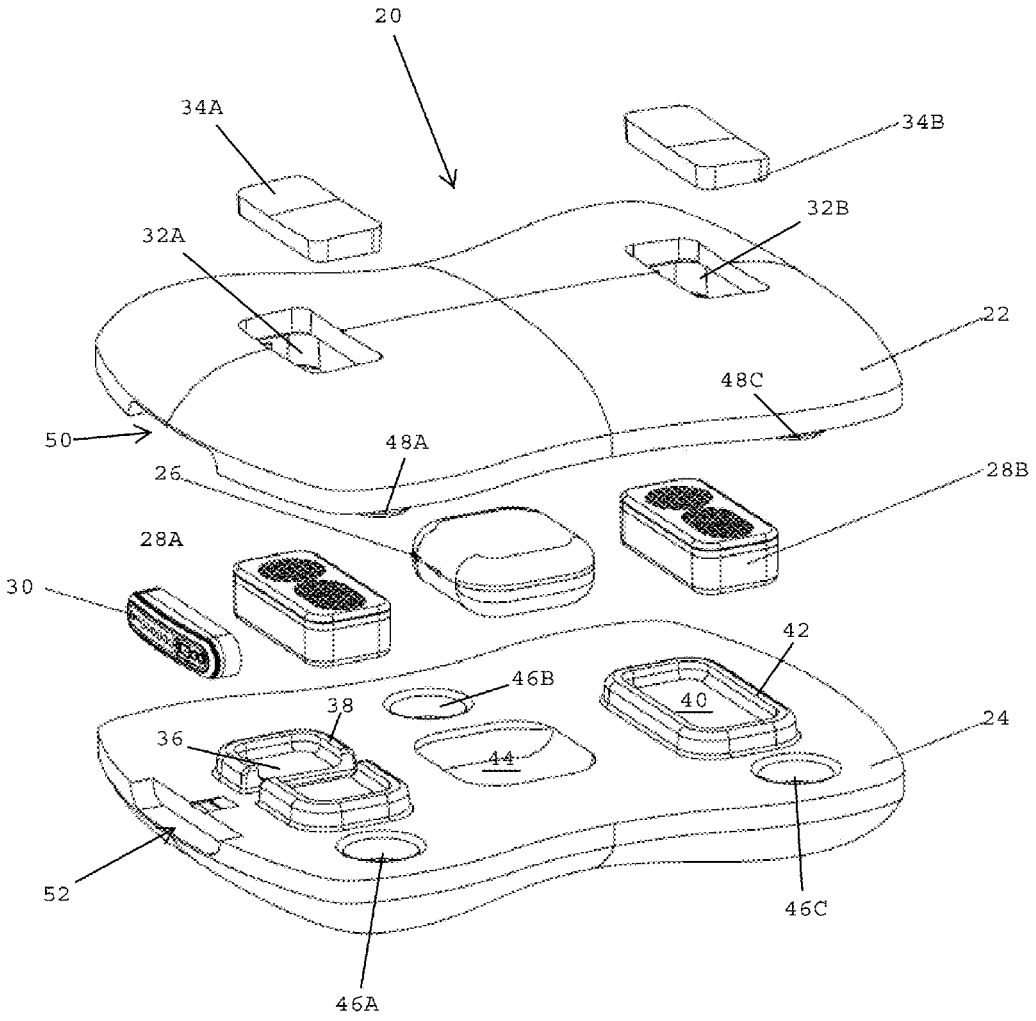
FIG. 1 shows an exploded view of an acoustic pillow, in accordance with one embodiment of the present invention.

Referring to FIG. 1, in one embodiment, an acoustic pillow 20 preferably includes a pillow body top 22 that is adapted to be assembled with a pillow body base 24. In one embodiment, the pillow body top and pillow body base are made of memory foam. The acoustic pillow 20 includes a controller housing 26, a pair of speaker housings 28A and 28B, and a controller interface housing 30 that are disposed between the pillow body top 22 and the pillow body base 24 when the top and the base are joined together.

In one embodiment, the pillow body top 22 includes a pair of speaker openings 32A, 32B that are adapted to receive and seat the speaker housings 28A, 28B. Acoustic inserts 34A, 34B are desirably inserted into the respective speaker openings 32A, 32B for overlying the speaker housings 28A, 28B.

In one embodiment, the pillow body base 24 has various recesses and/or projections molded therein. In one embodiment, the pillow body base 24 includes a first speaker recess 36 having a rim 38 that is adapted to receive the first speaker housing 28A. The pillow body base 24 also includes a second speaker recess 40 having a rim 42 that is adapted to receive the second speaker housing 28B. The pillow body base 24 also desirably includes a controller housing recess 44 adapted to receive the controller housing 26. In one embodiment, the pillow body base 24 includes assembly depressions 46A-46C that are adapted to receive corresponding assembly projections 48A-48C molded onto an underside of the pillow body top 22.

In one embodiment, one side of the pillow body top 22 and one side of the pillow body base 24 are molded to receive the controller interface housing 30. In one embodiment, a top interface housing groove 50 is molded into the pillow body top 22 and a bottom interface housing groove 52 is molded into the pillow body base 24. When the pillow body top 22 and the pillow body base 24 are assembled together, the controller interface housing 30 is adapted to be snuggly secured within the top groove 50 and the bottom groove 52 molded into the pillow body top and pillow body base, respectively.

Referring to FIGS. 2A-2E, in one embodiment, the pillow body top 22 is desirably made of memory foam. The pillow body top 22 includes the first speaker opening 32A and the second speaker opening 32B. The pillow body top 22 includes an outer surface 54 that forms an outer surface of an assembled acoustic pillow and an inner surface 56 that is juxtaposed with an inner surface of the pillow body base 24 (FIG. 1), as will be described in more detail herein. The pillow body top 22 preferably includes molded assembly projections 48A-48C that rise above the inner surface 56. In one embodiment, the assembly projections 48A-48C are inserted into the assembly depressions 46A-46C (FIG. 1) formed in the pillow body base 24.

Figure 2D:
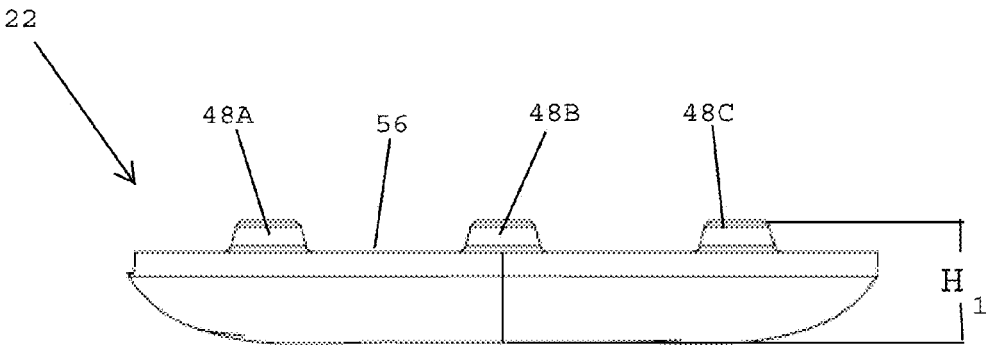
Figure 2E:
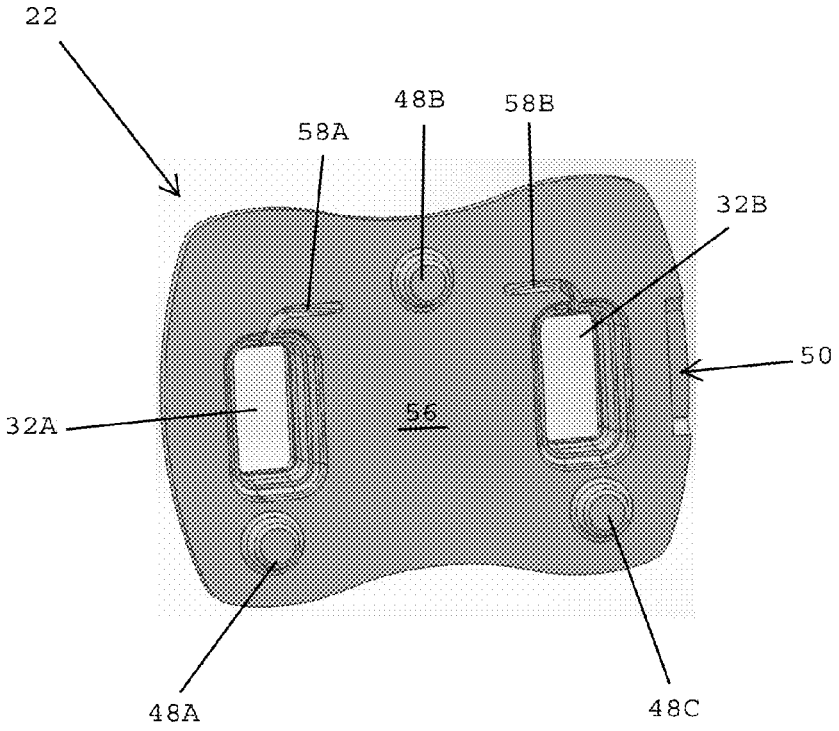

Referring to FIG. 2B, in one embodiment, the pillow body top 22 has a length $L_1$ of about 23.988 inches. Referring to FIG. 2C, in one embodiment, the pillow body top 22 has a width $W_1$ about 17.639 inches. Referring to FIG. 2D, in one embodiment, the pillow body top 22 has a height $H_1$ of about 3.855 inches. Referring to FIG. 2E, the inner surface 56 of the pillow body top 22 has wire channels 58A, 58B molded therein for directing conductive speaker wires into the speaker openings 32A, 32B for being connected with the speaker housings therein. The pillow body top 22 also includes the top groove 50 molded along one side thereof to provide a receptacle for the controller interface housing 30 (FIG. 1).

Referring to FIGS. 3A-3B, in one embodiment, the pillow body base 24 desirably includes an outer surface 60 that forms an exterior surface for an assembled acoustic pillow and an inner major surface 62 that is adapted to oppose the inner major surface 56 of the pillow body top 22 (FIG. 2E). The pillow body base 24 is preferably made of memory foam. In one embodiment, the pillow body base 24 includes the first speaker depression 36 that is surrounding by a rim 38 for receiving the first speaker housing 28A (FIG. 1). The pillow body base 24 includes the second speaker recess 40 surrounded by a rim 42 that is adapted to receive the second speaker housing 28B (FIG. 1). The pillow body base 24 also desirably includes the controller recess 44 adapted to receive the controller housing 26 (FIG. 1). The pillow body base also has assembly depressions 46A-46C formed therein that are adapted to mate with the projections 48A-48C (FIG. 2E) molded into the underside of the pillow body top.

In one embodiment, the pillow body base 24 includes a bottom groove 52 molded into one side thereof that is adapted to receive the controller interface housing 30 (FIG. 1). In one embodiment, a cable channel 64 is formed in the rim 38 to enable electronic cables and wiring to pass from the controller interface housing to the controller housing positioned atop the pillow body base 24.

Referring to FIGS. 2E and 3A, in one embodiment, when the pillow body top 22 is assembled with the pillow body base 24, the assembly projections 48A-48C on the pillow body top 22 form a friction fit with the assembly depressions 46A-46C on the pillow body base 24, and the rims 38, 42 on the pillow body base 24 form a friction fit with the speaker openings 32A, 32B on the pillow body top 22 for holding the pillow body top and the pillow body base together.

Referring to FIG. 3B, in one embodiment, the pillow body base 24 has a length $L_2$ of about 23.988 inches. Referring to FIG. 3C, in one embodiment, the pillow body base 24 has a width $W_2$ of about 17.639 inches. Referring to FIG. 3D, in one embodiment, the pillow body base 24 has a height $H_2$ (including the height of the rims 38, 42) of about 3.669 inches.

Referring to FIGS. 2E, 3A, and 4A, the acoustic pillow 20 is assembled together by juxtaposing the inner surface 56 of the pillow body top 22 with the inner surface 62 of the pillow body base 24 and inserting the molded assembly projections 48A-48C into the molded assembly depressions 46A-46C and inserting the rims 38, 42 into the speaker openings 32A, 32B.

Referring to FIGS. 4A-4D, in one embodiment, the outer surface 54 of the pillow body top 22 and the outer surface 60 of the pillow body base 24 define the outer surface of the assembled acoustic pillow 20. The controller interface housing 30 is preferably inserted into the top groove 50 molded into the pillow body top 22 and the bottom groove 52 molded into the pillow body base 24. The assembled pillow 20 desirably has a length $L_3$ (FIG. 4B—including the dimension of the controller interface housing 30 projecting from the side of the pillow) of about 24.200 inches, a width $W_3$ (FIG. 4) of about 17.639 inches, and a height $H_3$ (FIG. 4D) of about 5.750 inches.

Referring to FIGS. 1 and 5A-5D, in one embodiment, the acoustic pillow 20 includes acoustic inserts 34A, 34B that are inserted into the respective speaker openings 32A, 32B formed in the pillow body top 22. In one embodiment, the acoustic inserts 34 are made of open air foam or reticulated foam that enhances the acoustic properties of the acoustic pillow. As used herein, the term reticulated foam means a very porous, low density solid foam. Reticulated foams are extremely open foams, i.e., there are few, if any, intact bubbles or cell windows. In contrast, the foam formed by soap bubbles is composed solely of intact (e.g., fully enclosed) bubbles.

Referring to FIG. 5B, in one embodiment, the acoustic insert 34 has a width $W_4$ of about 2.583 inches. Referring to FIG. 5C, in one embodiment, the acoustic insert 34 has a length $L_4$ of about 5.668 inches. Referring to FIG. 5D, in one embodiment, the acoustic insert 34 has a height $H_4$ of about 0.826 inches.

Figure 6:
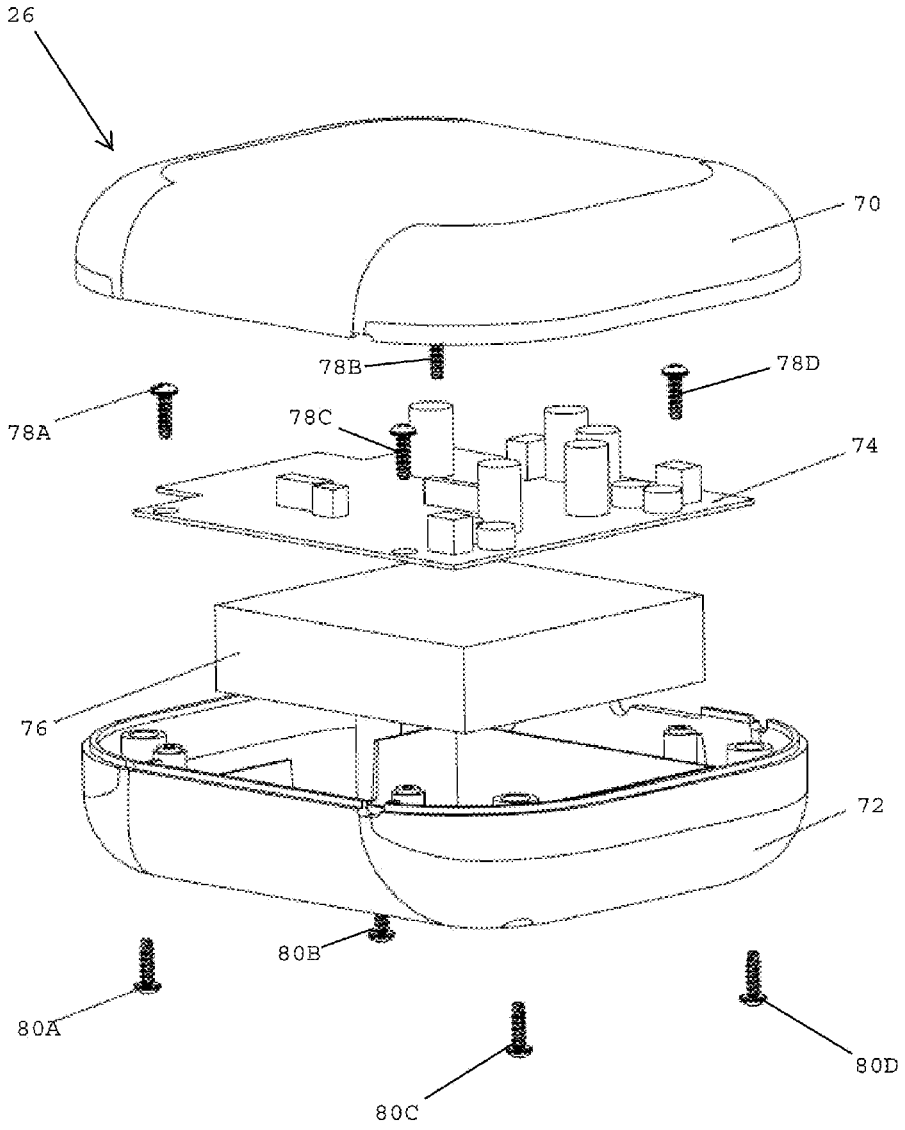
FIG. 6 shows an exploded view of a controller housing for an acoustic pillow, in accordance with one embodiment of the present invention.

Referring to FIG. 6, in one embodiment, an acoustic pillow includes a controller housing 26 having a controller housing top 70 that is assembled with a controller housing bottom 72. In one embodiment, a circuit board 74 that contains one or more microelectronic controllers and electronic components for controlling the operation of the acoustic pillow is disposed between the controller housing top 70 and controller housing bottom 72. In one embodiment, a power source 76, such as a lithium battery, is disposed inside the controller housing, preferably between the circuit board 74 and the control housing base 72. In one embodiment, a first set of fasteners 78A-78D (e.g., screws) are utilized for securing the circuit board to the controller housing base 72. A second set of fasteners 80A-80D (e.g., screws) may be utilized for assembling the controller housing top 70 with the controller housing base 72. In one embodiment, the controller housing 26 is preferably in electrical communication and signal sending and receiving communication with the controller interface housing 30 and the two speakers 28A, 28B (FIG. 1) for controlling operation of the acoustic pillow. In one embodiment, the controller housing circuit board 74 includes one or more electrical components for conducting wireless communication protocols such as Blue Tooth communication protocols.

Figure 7:
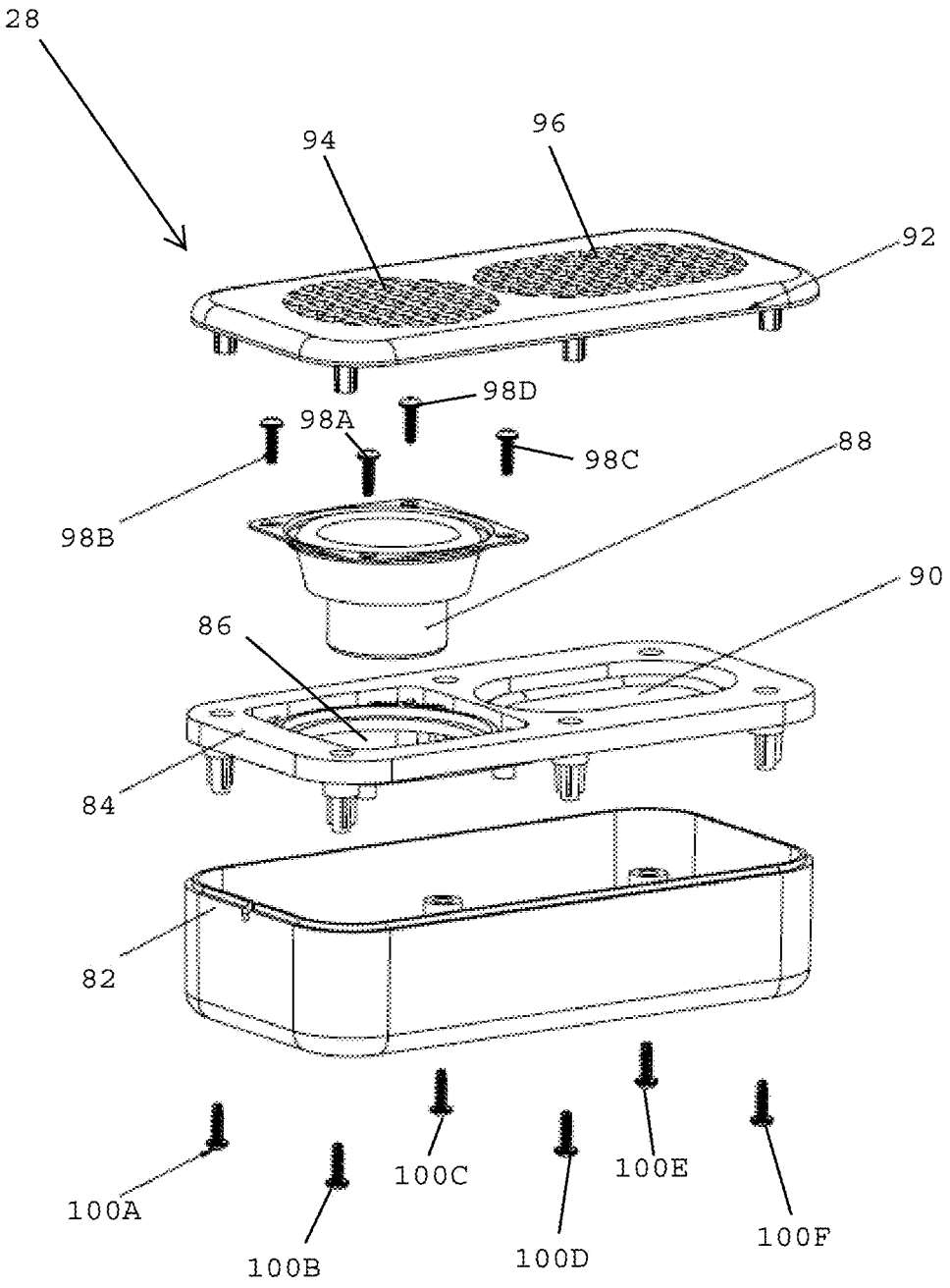
FIG. 7 shows an exploded view of a speaker housing assembly for an acoustic pillow, in accordance with one embodiment of the present invention.

Referring to FIG. 7, in one embodiment, the speaker assembly 28 preferably includes a speaker housing base 82 that is adapted to receive one or more speakers and be assembled with a speaker housing top 84. The speaker housing top 84 includes a first opening 86 adapted to receive a speaker 88 and a second opening 90 adapted to receive a passive radiator. The speaker housing 28 also desirably includes a speaker housing grill 92 having a first grill opening pattern 94 associated with the speaker 88 and a second grill opening pattern 96 associated with the passive radiator opening 90.

In one embodiment, the speaker housing 28 includes a first set of fasteners 98A-98D (e.g., screws) that are used to secure the speaker 88 to the speaker housing top 84. The speaker housing 28 includes a second set of fasteners 100A-100F (e.g., screws) that are adapted to firmly secure the speaker housing top 84 and the speaker grill 92 to the speaker housing base 82. In one embodiment, the assembly shown in FIG. 7 enables the formation of a sealed speaker cabinet whereby air cannot flow into or out of the cabinet for improving the acoustic performance of the speaker housing 28.

Referring to FIGS. 8A-8D, in one embodiment, the assembled speaker housing 28 has a width $W_5$ (FIG. 8B) of about 3.024 inches, a length $L_5$ (FIG. 8C) of about 6.102 inches, and a height $H_5$ (FIG. 8D) of about 1.769 inches.

Referring to FIGS. 9A-9D, in one embodiment, the speaker housing base 82 has spaced posts 102A-102F having threaded female openings that are adapted to receive the second set of fasteners 100A-100F (FIG. 7) for securing the speaker housing top 84 and the speaker housing grill 92 to the speaker housing base 82. In one embodiment, the speaker housing base 82 has a width $W_6$ (FIG. 9B) of about 3.024 inches, a length $L_6$ (FIG. 9C) of about 6.102 inches, and a height $H_6$ (FIG. 9D) of about 1.374 inches.

Referring to FIGS. 7 and 10A-10D, in one embodiment, the speaker housing top 84 is adapted to be assembled with the speaker housing bottom 82. In one embodiment, the speaker housing top 84 includes the first opening 86 for the speaker 88 and the second opening 90 for the passive radiator. In one embodiment, the first speaker opening 86 includes a set of female threaded openings 104A-104D that are adapted to receive the fasteners 98A-98D (FIG. 7) for securing the speaker 88 within the first speaker opening 86. The speaker housing top 84 also includes posts 106A-106E projecting from an underside thereof. The posts 106A-106F preferably have female threaded openings adapted to receive the fasteners 100A-100F for securing the speaker housing top 84 to the speaker housing bottom 82. In one embodiment, the upper ends of the fasteners 100A-100F also secure the speaker grill 92 to the speaker housing base.

In one embodiment, the passive speaker opening 90 has an oval or elongated shape for maximizing the surface area, which, in turn, enhances the acoustical performance of the pillow.

In one embodiment, the speaker housing top 84 has a width $W_7$ (FIG. 10B) of about 3.015 inches, a length $L_7$ (FIG. 10C) of about 6.102 inches, and a height $H_7$ (FIG. 10D) of about 0.787 inches.

Referring to FIGS. 10A and 11A-11D, in one embodiment, a passive radiator 108 is inserted into the passive radiator opening 90 provided in the speaker housing top 84. In one embodiment, the passive radiator 108 has a width $W_8$ (FIG. 11B) of about 1.575 inches, a length $L_8$ (FIG. 11C) of about 2.756 inches, and a height $H_8$ (FIG. 11D) of about 0.098 inches.

Referring to FIGS. 7 and 12A-12D, in one embodiment, the speaker 88 secured to the speaker housing top 84 has a central, vibrating component 110 and a speaker frame 112 has openings 114A-114D adapted to receive the fasteners 98A-98D for securing the speaker frame to the speaker housing top. In one embodiment, the speaker frame 112 has a width $W_9$ (FIG. 12B) of about 2.168 inches, a length $L_9$ (FIG. 12C) of about 2.168 inches, and a height $H_9$ (FIG. 12D) of about 1.154 inches.

Referring to FIGS. 7 and 13A-13D, in one embodiment, the speaker housing 28 includes the speaker housing grill 92 that overlies the speaker housing top 84 and the speaker housing base 82. In one embodiment, the speaker housing grill 92 includes the first grill pattern 94 that is aligned with the speaker 88 and the second grill pattern 96 that is aligned with the passive radiator 108 (FIG. 11A). In one embodiment, the speaker housing grill 92 includes posts 116A-116F that project from an underside of the speaker housing grill 92. In one embodiment, the posts 116A-116F have threaded female openings that are adapted to receive the fasteners 110A-100F (FIG. 7) for assembling the speaker housing grill and the speaker housing top with the speaker housing base. In one embodiment, the speaker housing grill 92 has a width $W_{10}$ (FIG. 13B) of about 3.024 inches, a length $L_{10}$ (FIG. 13C) of about 6.102 inches, and a height $H_{10}$ (FIG. 13D—including the post height) of about 0.542 inches.

Figure 14:
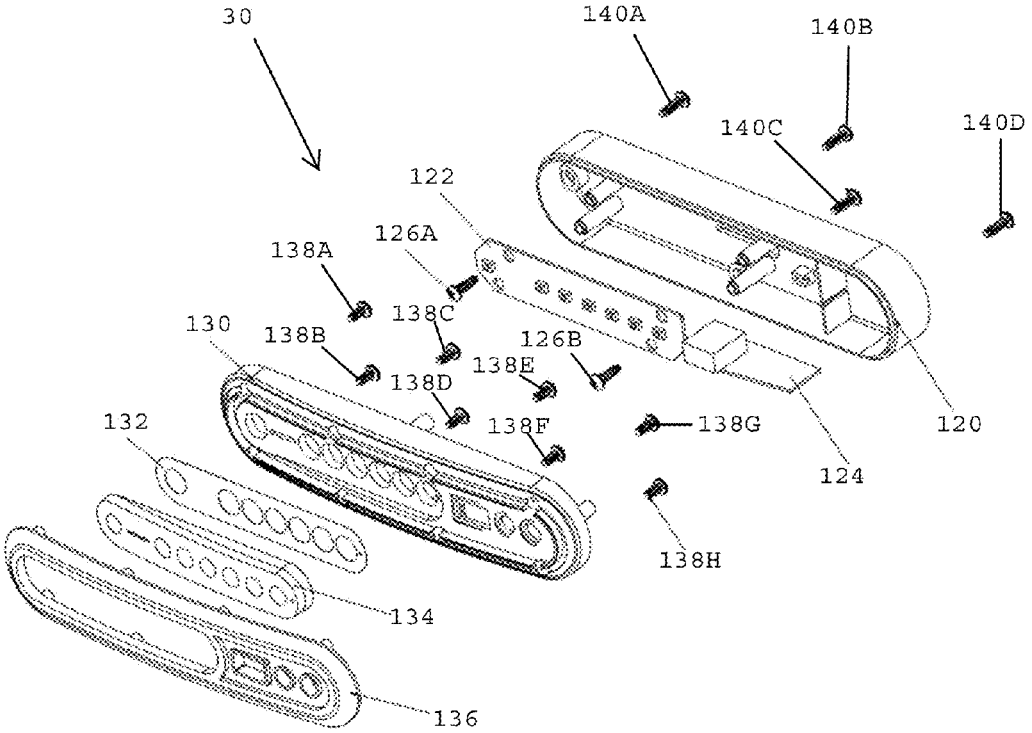
FIG. 14 shows an interface housing assembly, in accordance with one embodiment of the present invention.

Referring to FIG. 14, in one embodiment, the controller interface housing 30 preferably includes an interface housing base 120 that is adapted to receive a button board 122 and an input/output port board 124. Fasteners 126A, 126B (e.g., screws) are utilized for securing the button board 122 to the interface housing base 120.

In one embodiment, the controller interface housing 30 includes an interface housing top 130 that seats an adhesive strip 132 and a button pad 134. An interface plate 136 is assembled over the adhesive strip 132 and the button pad 134 and is secured with the interface housing top 130 using fasteners 138A-138H (e.g., screws). The subassembly including the interface housing top 130 is assembled with the interface housing base 120 using fasteners 140A-140D.

In one embodiment, a flexible cover (e.g., fabric, leather) is positioned over the pillow body top and the pillow body base to provide a flexible pillow cover. The flexible cover has an opening that is aligned with the controller interface housing and that generally matches the shape of the outer perimeter of the controller interface housing 30 (FIG. 1). In one embodiment, the edge of the flexible cover surrounding the opening is captured between the rim of the interface housing base 120 and the underside of the interface housing top 130 for snuggly securing the perimeter of the opening of the flexible cover to the controller interface housing to prevent the flexible cover from shifting relative to the controller interface housing.

Figure 15D:
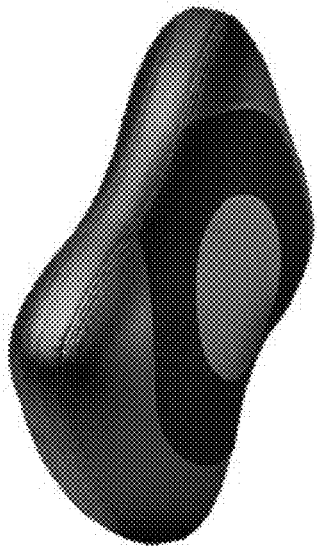
Figure 15E:
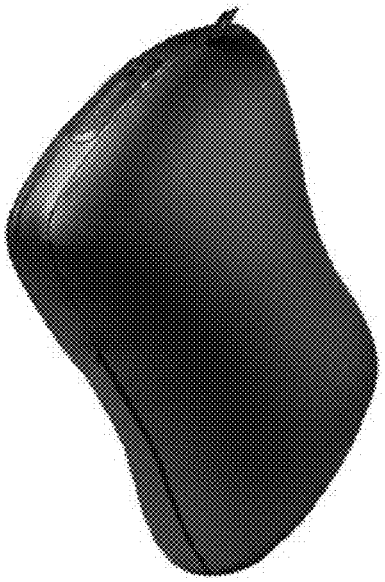
Figure 15F:
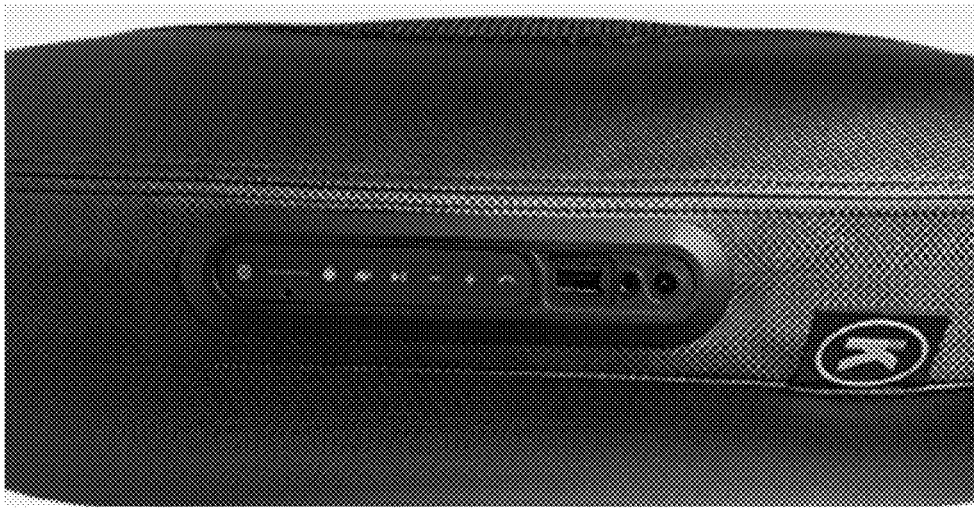

FIG. 15 shows a top plan view of acoustic pillow 20, in accordance with one embodiment of the present invention. In one embodiment, the top surface of the cover of the acoustic pillow 20 has a pattern that looks like a speaker.

Figure 16:
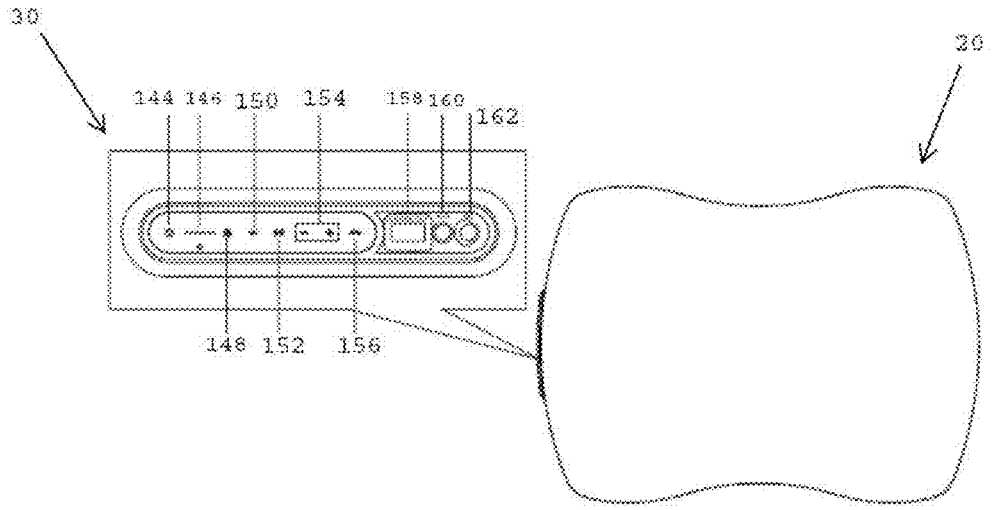
FIG. 16 shows an acoustic pillow including an interface housing assembly, in accordance with one embodiment of the present invention.

Referring to FIG. 16, in one embodiment, the controller interface housing 30 is accessible at the side of an acoustic pillow 20. In one embodiment, the controller interface housing 30 includes a power indicator 144 for indicating if power is on, a battery indicator 146 for indicating battery power, a party mode indicator 148, a true wireless indicator 150, and a play/pause button 152. In one embodiment, the controller interface housing 30 also desirably includes a volume control button 154, a telephone control button 156 for operating a telephone, a USB charging port 158, an auxiliary audio input port 160, and a direct current connection 162 for connecting the battery to a power source (e.g., an AC wall socket).

Figure 17A:
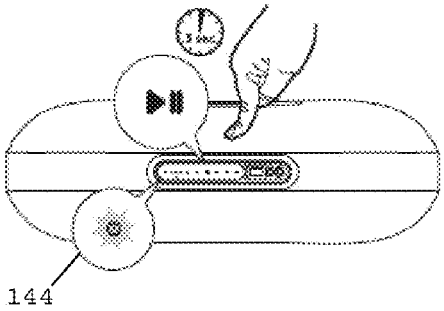
FIGS. 17A-17I show a method of using an acoustic pillow, in accordance with one embodiment of the present invention.

FIG. 17A-17I disclose a method of operating an acoustic pillow, in accordance with one embodiment of the present invention. Referring to FIG. 17A, in one embodiment, a user depresses the power button 144 to turn on power for the acoustic pillow. In one embodiment, the user presses and holds the play/pause button 152 for approximately three seconds whereupon the acoustic pillow enters the pairing mode. In one embodiment, the power button 144 blinks on and off.

Figure 17B:
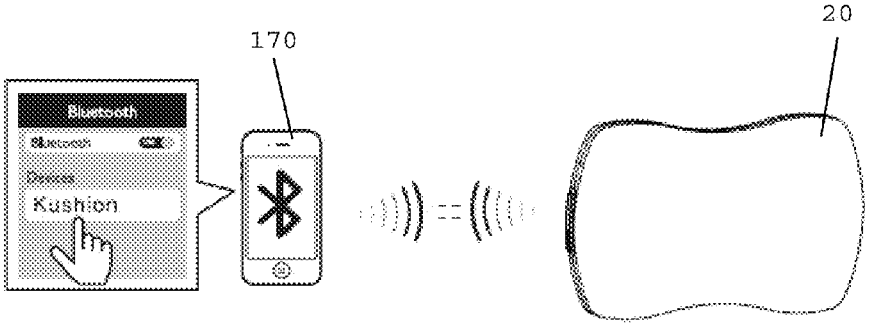

Referring to FIG. 17B, in one embodiment, a user utilizes a mobile device 170 to activate a wireless or Blue Tooth communications protocol and search for and select the acoustic pillow 20 to establish a wireless connection between the mobile device 170 and the acoustic pillow 20.

Figure 17C:
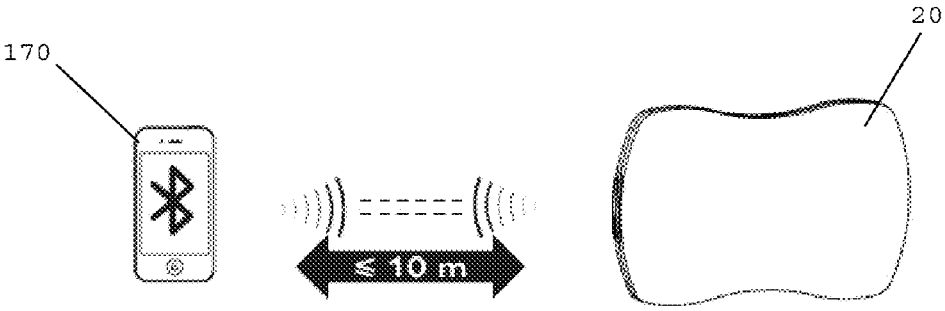

Referring to FIG. 17C, in one embodiment, a user may select and play audio files or music on the mobile device 170, which, in turn, is transmitted and played on the speakers of the acoustic pillow 20.

Figure 17D:
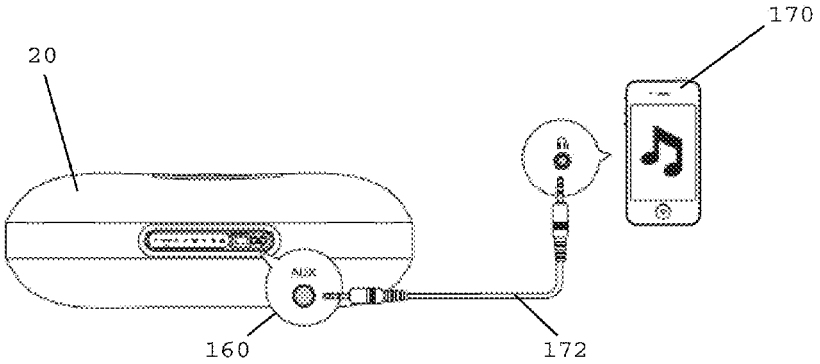

Referring to FIG. 17D, in one embodiment, a communications cable 172 may be utilized for connecting an electronic device 170, such as an MP3 player, to the acoustic pillow 20. In one embodiment, the cable 172 forms a communication interface between the auxiliary input 160 and the electronic device 170.

Figure 17E:
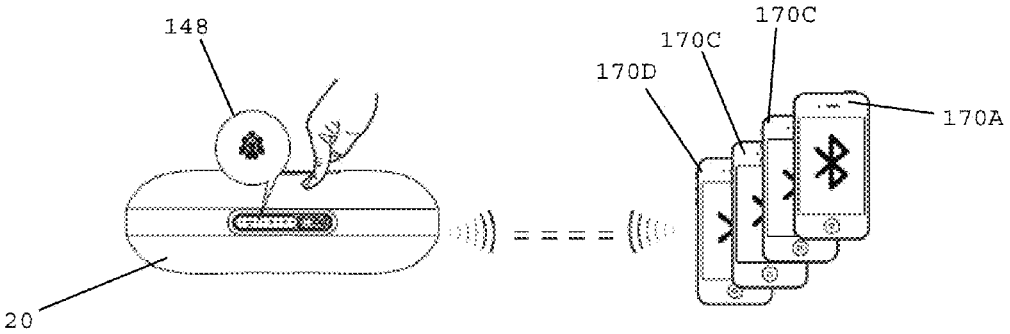

Referring to FIG. 17E, in one embodiment, the party mode button 148 may be utilized to enable up to four different wireless devices 170A-170D to establish electronic communication with the acoustic pillow 20. As a result, the acoustic pillow 20 may wirelessly interface with any of the four wireless devices 170A-170D and the devices may send and play music through the speakers of the acoustic pillow. In one embodiment, the party mode is initiated by pressing the party mode button 148 a first time. Subsequently, the party mode may be ended by pressing the party mode button 148 a second time.

Figure 17F:
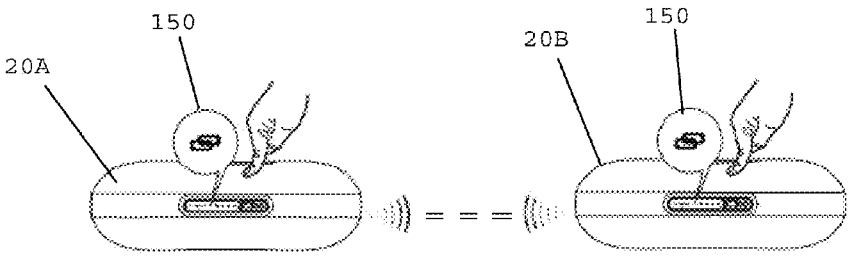

Referring to FIG. 17F, in one embodiment, a user may depress the true wireless button 150 for linking a pair of acoustic pillows 20A, 20B together, thereby allowing them to be controlled by a single electronic device 170 (FIG. 17D). The true wireless button 150 may be pressed a second time to unlink the two acoustic pillows 20A, 20B.

Figure 17G:
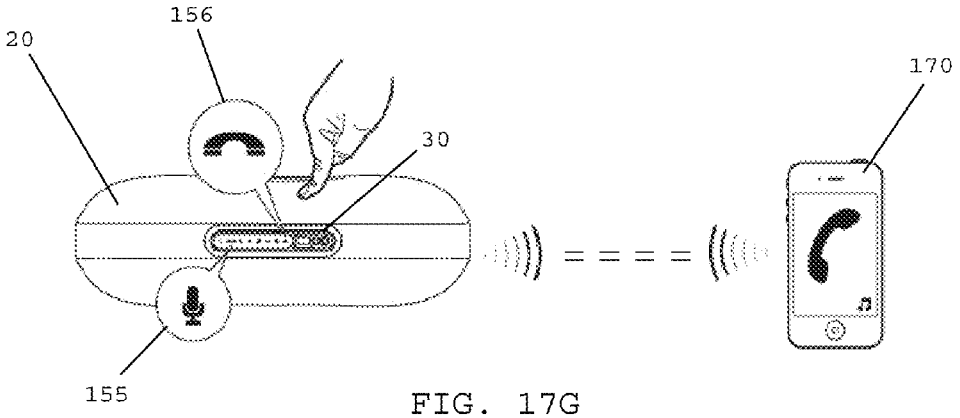

Referring to FIG. 17G, in one embodiment, the acoustic pillow 20 may be used to receive and make telephone calls. In one embodiment, the telephone button 156 may be utilized for originating and receiving telephone calls via a mobile device 170. In one embodiment, the controller interface housing 30 includes a microphone 155 that enables the user to communicate via the acoustic pillow 20. In one embodiment, for an incoming call, the telephone button 156 is pressed once to answer the call. In one embodiment, for an incoming call, the telephone button 156 is pressed and held in a depressed position to reject an incoming call. In one embodiment, while on a call, a user may end the call by pressing the telephone button 156 once.

In one embodiment, with an incoming call while on an existing call, a user may hold the current call and answer the incoming call by pressing the telephone button 156 once. The user may then again press the telephone button 156 to end the current call and return to the call on hold. A user may press and hold the telephone button 156 in a depressed position for ending both calls.

Figure 17H:
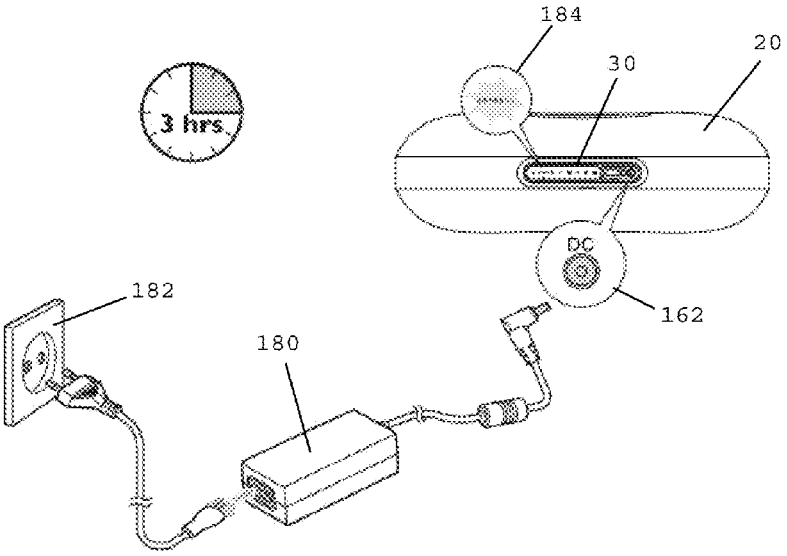

Referring to FIG. 17H, in one embodiment, the battery for the acoustic pillow 20 may be charged utilizing a DC power supply 180 that may be plugged into an AC wall socket 182. In one embodiment, the controller interface housing 30 has a DC outlet 162 for connecting to the DC power supply 180. In one embodiment, the control interface housing 30 includes power indicator lights 146 to indicate the battery level. In one embodiment, seven power indicator lights 146 are illuminated for indicating battery power of 95% or greater. In one embodiment, five power indicator lights 146 are illuminated to indicate battery power of less than 75%. In one embodiment, three power indicator lights 146 are illuminated to indicate battery power of less than 50%. In one embodiment, one power indicator light 146 is illuminated to indicate battery power of less than 25%.

Figure 17I:
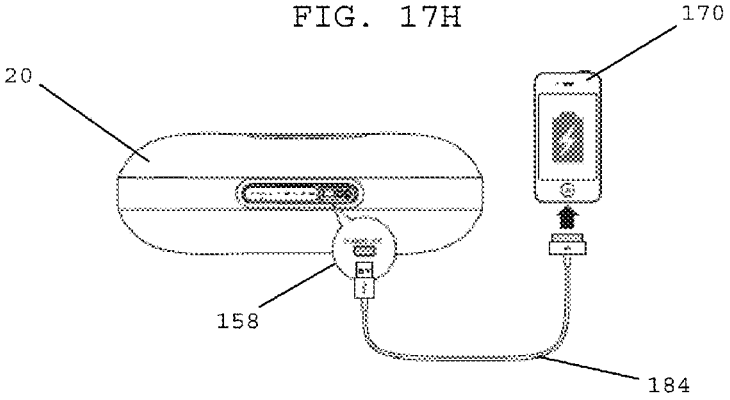

Referring to FIG. 17I, in one embodiment, the acoustic pillow 20 may be utilized to charge a mobile device 170. A USB cable 184 may interconnect the USB port 158 and the mobile device 170.

Figure 18A:
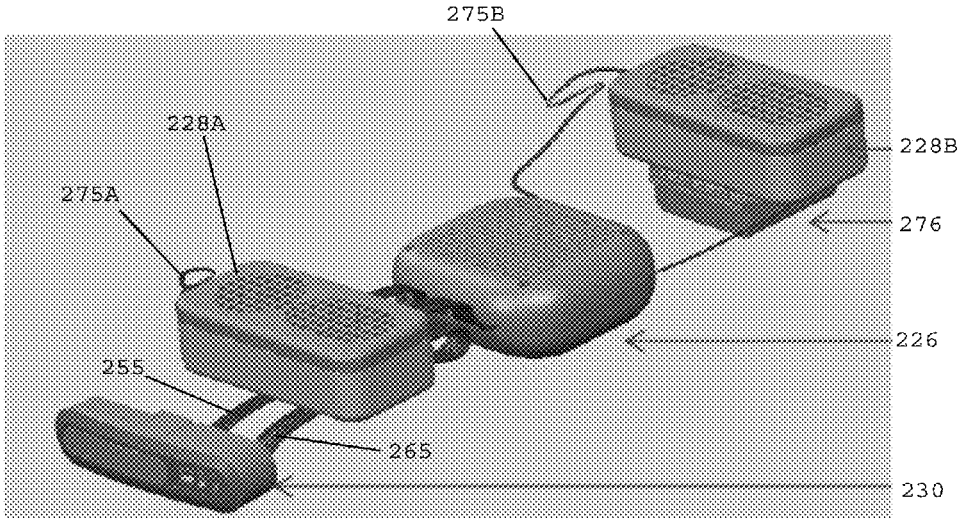
FIGS. 18A-18B show a wiring configuration for a control interface assembly, a controller housing, and two speakers, in accordance with embodiment of the present invention.
Figure 18B:
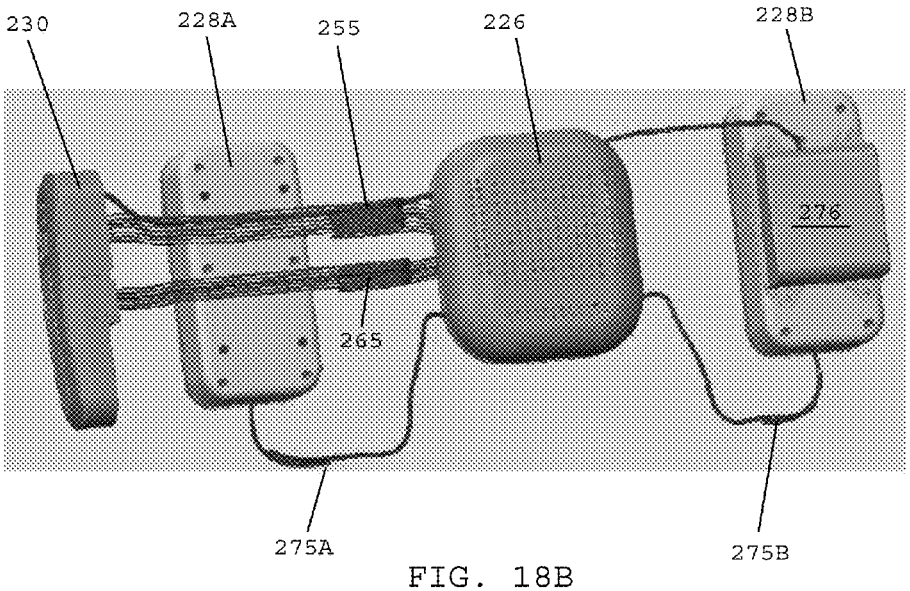
Figure 19:
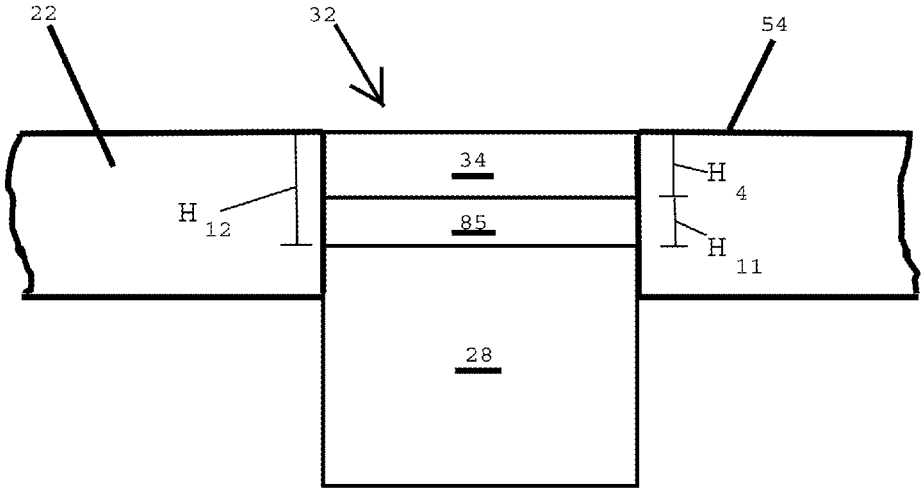
FIG. 19 shows a cross-section view of a pillow body top having a speaker opening, a speaker housing disposed in the speaker opening, and an acoustic insert inserted into the speaker opening and overlying the speaker housing, in accordance with one embodiment of the present invention.

Referring to FIGS. 18A and 18B, in one embodiment, an acoustic pillow includes a controller interface housing 230, a controller housing 226, and a pair of speakers 228A, 228B. The controller interface housing 230 is electrically interconnected with the controller housing 226 via interface cables 255, 265. The interface cables 255, 265 enable the acoustic pillow to be operated by the controller interface housing 230 by using the buttons and components accessible at the front face of the controller interface housing. The speakers 228A, 228B are in communication with the controller housing 226 via speaker wires 275A, 275B. The speaker wires 275A, 275B preferably have slack to provide for some flexibility and movement between the first and second speakers 228A, 228B and the controller housing 226 so that the speaker wires do not become damaged during use of the acoustic pillow. In one embodiment, a power source 276 may be secured to an underside of the second speaker housing 228B. In one embodiment, the power source 276 may be disposed inside the controller housing 226.

In one embodiment, the pillow body top 22 has a speaker opening 32 formed in the top surface 54. The upper end of the speaker housing 28 is inserted into the lower end of the speaker opening 32 to form a friction fit between the speaker housing and the speaker opening. An acoustic insert 34 is inserted into the speaker opening 32 for overlying the speaker grill of the speaker housing 28. The acoustic insert 34 has a top surface that lies in the same plane as the top surface 54 of the pillow body top 22. The acoustic insert 34 has a height $H_4$ of about 0.826 inches. An air gap 85 having a height $H_{11}$ of about 0.674 inches is located between the bottom surface of the acoustic insert 34 and the top surface of the speaker housing 28. The top surface of the speaker housing 28 is spaced away from the top surface 54 of the pillow body top 22 by a distance H12 of about 1.50 inches. It has been determined that spacing the top surface of the speaker housing 1.50 inches below the top surface 54 of the pillow body top 22, providing the air gap 85 between the bottom surface of the acoustic insert 34 and the top surface of the speaker housing 28, and providing the acoustic insert 34 in the speaker opening 32 enhances the acoustic performance of the acoustic pillow. It has also been determined that forming the acoustic insert 34 of an open air foam material or reticulated foam enhances the acoustic performance of the acoustic pillow.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. An acoustic pillow comprising:

a pillow body top having an outer surface and an inner surface with assembly projections extending from said inner surface;

a pillow body base having an outer surface and an inner surface with assembly depressions molded into said inner surface of said pillow body base;

said pillow body top being assembled with said pillow body base with said inner surface of said pillow body top opposing said inner surface of said pillow body base and said assembly projections inserted into said assembly depressions;

a wireless communication system disposed between said pillow body top and said pillow body base, said wireless communication system including a controller housing, a power source, at least one speaker housing, and a controller interface housing;

first and second speaker openings formed in said pillow body top that extend from said outer surface to said inner surface of said pillow body top;

first and second speaker rims projecting above said inner surface of said pillow body base, wherein at least said first speaker rim is inserted into said first speaker opening.

2. The acoustic pillow as claimed in claim 1, wherein said controller housing comprises a circuit board having at least one microprocessor and at least one a wireless communication device for sending and receiving wireless signals.

3. The acoustic pillow as claimed in claim 2, wherein said pillow body base further comprises a controller housing depression molded into said inner surface of said pillow body base and said controller housing is disposed in said controller housing depression.

4. The acoustic pillow as claimed in claim 2, wherein said power source in disposed in said controller housing.

5. The acoustic pillow as claimed in claim 2, wherein said controller interface housing is in signal sending and receiving communication with said circuit board including said at least one microprocessor and said at least one wireless communication device.

6. The acoustic pillow as claimed in claim 5, wherein said controller interface housing comprises buttons, ports, and visual indicators for interacting with said controller housing and operating said acoustic pillow.

7. The acoustic pillow as claimed in claim 1, wherein said at least one speaker housing comprises:

a first speaker housing having a lower end surrounded by said first speaker rim and an upper end inserted into said first speaker opening; and a second speaker housing having a lower end surrounded by said second speaker rim and an upper end inserted into said second speaker opening.

8. The acoustic pillow as claimed in claim 7, further comprising:

a first acoustic insert disposed in said first speaker opening, said first acoustic insert having a top surface that lies in a plane defined by said outer surface of said pillow body top and a bottom surface spaced away from said outer surface of said pillow body top; and a second acoustic insert disposed in said second speaker opening, said second acoustic insert having a top surface that lies in a plane defined by said outer surface of said pillow body top and a bottom surface spaced away from said outer surface of said pillow body top.

9. The acoustic pillow as claimed in claim 8, wherein said first acoustic insert has a thickness of about 0.700-0.900 inches and said upper end of said first speaker housing is spaced away from said bottom surface of said first acoustic insert by about 0.600-0.800 inches, and wherein said second acoustic insert has a thickness of about 0.700-0.900 inches and said upper end of said second speaker housing is spaced away from said bottom surface of said second acoustic insert by about 0.600-0.800 inches.

10. The acoustic pillow as claimed in claim 9, wherein said upper ends of said first and second speaker housings are about 1.50 inches below said outer surface of said pillow body top.

11. The acoustic pillow as claimed in claim 8, wherein said first and second acoustic inserts comprise reticulated foam.

12. The acoustic pillow as claimed in claim 1, further comprising:

a first controller interface housing groove formed on one side of said pillow body top; and a second controller interface housing groove formed on one side of said pillow body base that opposes said first controller interface housing groove, wherein said controller interface housing is disposed between said first and second controller interface housing grooves for securing said controller interface housing to one side of said acoustic pillow.

13. The acoustic pillow as claimed in claim 12, further comprising conductive wires interconnecting said controller interface housing and said controller housing, and speaker wires interconnecting said controller housing and said at least one speaker housing.

14. The acoustic pillow as claimed in claim 1, wherein said pillow body top and said pillow body base comprise memory foam.

15. The acoustic pillow as claimed in claim 14, further comprising a flexible cover surrounding said pillow body top and said pillow body base.

16. The acoustic pillow as claimed in claim 15, wherein said flexible cover is a material selected from the group consisting of cloth, fabric, leather, plastic, and combinations thereof.

17. An acoustic pillow comprising:

a pillow body top comprising memory foam, said pillow body top having an outer surface, an inner surface with assembly projections extending from said inner surface, and first and second speaker openings that extend from said outer surface to said inner surface of said pillow body top;

a pillow body base comprising memory foam, said pillow body base having an outer surface and an inner surface with assembly depressions molded into said inner surface of said pillow body base, said pillow body base including first and second molded speaker rims projecting above said inner surface of said pillow body base;

said pillow body top being assembled with said pillow body base with said inner surface of said pillow body top opposing said inner surface of said pillow body base, said assembly projections inserted into said assembly depressions, said first molded speaker rim inserted into said first speaker opening, and said second molded speaker rim inserted into said second speaker opening;

a first speaker housing having a lower end surrounded by said first molded speaker rim and an upper end inserted into said first speaker opening;

a second speaker housing having a lower end surrounded by said second molded speaker rim and an upper end inserted into said second speaker opening;

a first acoustic insert comprising reticulated foam disposed in said first speaker opening and overlying said first speaker housing, said first acoustic insert having a top surface that lies in a plane defined by said outer surface of said pillow body top and a bottom surface spaced away from said outer surface of said pillow body top; and a second acoustic insert comprising reticulated foam disposed in said second speaker opening and overlying said second speaker housing, said second acoustic insert having a top surface that lies in a plane defined by said outer surface of said pillow body top and a bottom surface spaced away from said outer surface of said pillow body top.

18. The acoustic pillow as claimed in claim 17, wherein said first acoustic insert has a thickness of about 0.700-0.900 inches and said upper end of said first speaker housing is spaced away from said bottom surface of said first acoustic insert by about 0.600-0.800 inches, and wherein said second acoustic insert has a thickness of about 0.700-0.900 inches and said upper end of said second speaker housing is spaced away from said bottom surface of said second acoustic insert by about 0.600-0.800 inches.

19. The acoustic pillow as claimed in claim 17, further comprising a wireless communication system disposed between said pillow body base and said pillow body top, said wireless communication system including a controller housing, a power source, said first and second speaker housings in communication with said controller housing, and a controller interface housing in communication with said controller housing.

* * * * *